US007134959B2

(12) United States Patent
Penrice

(10) Patent No.: US 7,134,959 B2
(45) Date of Patent: Nov. 14, 2006

(54) METHODS AND APPARATUS FOR PROVIDING A LOTTERY GAME

(75) Inventor: Stephen Penrice, Morristown, NJ (US)
(73) Assignee: Scientific Games Royalty Corporation, Newark, DE (US)

( * ) Notice: Subject to any disclaimer, the term of this patent is extended or adjusted under 35 U.S.C. 154(b) by 21 days.

(21) Appl. No.: 10/603,539

(22) Filed: Jun. 25, 2003

(65) Prior Publication Data

US 2004/0266514 A1 Dec. 30, 2004

(51) Int. Cl.
*A63F 9/24* (2006.01)

(52) U.S. Cl. ..... 463/17

(58) Field of Classification Search ..... 463/17, 463/18, 16

See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | BNugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |
| 3,918,174 | A | 11/1975 | Miller et al. |
| 3,922,529 | A | 11/1975 | Orloff |
| 3,934,120 | A | 1/1976 | Maymarev |
| 4,017,834 | A | 4/1977 | Cuttill et al. |
| 4,095,824 | A | 6/1978 | Bachman |
| 4,105,156 | A | 8/1978 | Dethloff |

(Continued)

FOREIGN PATENT DOCUMENTS

| | | |
|---|---|---|
| AU | B-18428/92 | 12/1992 |

(Continued)

OTHER PUBLICATIONS

'Are You In?', (Article).

(Continued)

*Primary Examiner*—Corbett B. Coburn
(74) *Attorney, Agent, or Firm*—Carlton Fields PA

(57) ABSTRACT

A gaming apparatus may comprise a value input device and a controller operatively coupled to the value input device. The controller may comprise a processor and a memory, and may be programmed to receive wager data in response to a wager made by a person on a game, where the wager data may comprise a first plurality of indicia of a first type selected by the person, to receive data representing a second plurality of indicia of the first type, where the second plurality of indicia of the first type may be randomly selected, to replace one or more of the indicia of a first type in at least one of the first plurality of indicia and the second plurality of indicia with an indicia of a second type, to determine whether any of the first plurality of indicia of the first type match any of the second plurality of indicia of the first type, to match the indicia of the second type with at least one of the second plurality of indicia of the first type if the indicia of a second type replaced an indicia of a first type from the first plurality of indicia, to match the indicia of the second type with at least one of the first plurality of indicia of the first type if the indicia of a second type replaced an indicia of a first type from the second plurality of indicia, and to determine a value payout associated with an outcome of the lottery game.

10 Claims, 10 Drawing Sheets

U.S. PATENT DOCUMENTS

| | | | |
|---|---|---|---|
| 4,176,406 | A | 11/1979 | Matkan |
| 4,191,376 | A | 3/1980 | Goldman et al. |
| 4,194,296 | A | 3/1980 | Pagnozzi et al. |
| 4,195,772 | A | 4/1980 | Nishimura |
| 4,206,920 | A | 6/1980 | Weatherford et al. |
| 4,241,942 | A | 12/1980 | Bachman |
| 4,243,216 | A | 1/1981 | Mazumder |
| 4,273,362 | A | 6/1981 | Carrier et al. |
| 4,309,452 | A | 1/1982 | Sachs |
| 4,313,087 | A | 1/1982 | Weitzen et al. |
| 4,355,300 | A | 10/1982 | Weber |
| 4,375,666 | A | 3/1983 | Buck et al. |
| 4,398,708 | A | 8/1983 | Goldman et al. |
| 4,407,443 | A | 10/1983 | McCorkle |
| 4,451,759 | A | 5/1984 | Heynisch |
| 4,455,039 | A | 6/1984 | Weitzen et al. |
| 4,457,430 | A | 7/1984 | Darling et al. |
| 4,464,423 | A | 8/1984 | LaBianca et al. |
| 4,466,614 | A | 8/1984 | Bachman et al. |
| 4,488,646 | A | 12/1984 | McCorkle |
| 4,491,319 | A | 1/1985 | Nelson |
| 4,494,197 | A | 1/1985 | Troy et al. |
| 4,536,218 | A | 8/1985 | Ganho |
| 4,544,184 | A | 10/1985 | Freund et al. |
| 4,579,371 | A | 4/1986 | Long et al. |
| 4,591,189 | A | 5/1986 | Holmen et al. |
| 4,634,149 | A | 1/1987 | Donovan |
| 4,665,502 | A | 5/1987 | Kreisner |
| 4,669,729 | A | 6/1987 | Solitt et al. |
| 4,689,742 | A | 8/1987 | Troy et al. |
| 4,726,608 | A | 2/1988 | Walton |
| 4,736,109 | A | 4/1988 | Dvorzsak |
| 4,740,016 | A | 4/1988 | Konecny et al. |
| 4,760,247 | A | 7/1988 | Keane et al. |
| 4,763,927 | A | 8/1988 | Schneider |
| 4,775,155 | A | 10/1988 | Lees |
| 4,792,667 | A | 12/1988 | Chen |
| 4,805,907 | A | 2/1989 | Hagiwara |
| 4,817,951 | A | 4/1989 | Crouch et al. |
| 4,835,624 | A | 5/1989 | Black et al. |
| 4,836,546 | A | 6/1989 | DiRe et al. |
| 4,836,553 | A | 6/1989 | Suttle et al. |
| 4,837,728 | A | 6/1989 | Barrie et al. |
| 4,856,787 | A | 8/1989 | Itkis |
| 4,861,041 | A | 8/1989 | Jones et al. |
| 4,870,260 | A | 9/1989 | Niepolomski et al. |
| 4,880,964 | A | 11/1989 | Donahue |
| 4,888,964 | A | 12/1989 | Klinge |
| 4,922,522 | A | 5/1990 | Scanlon |
| 4,943,090 | A | 7/1990 | Fienberg |
| 4,960,611 | A | 10/1990 | Fujisawa et al. |
| 4,961,578 | A | 10/1990 | Chateau |
| 4,964,642 | A | 10/1990 | Kamille |
| 4,996,705 | A | 2/1991 | Entenmann et al. |
| 4,998,010 | A | 3/1991 | Chandler et al. |
| 4,998,199 | A | 3/1991 | Tashiro et al. |
| 5,032,708 | A | 7/1991 | Comerford et al. |
| 5,037,099 | A | 8/1991 | Burtch |
| 5,046,737 | A | 9/1991 | Fienberg |
| 5,074,566 | A | 12/1991 | Desbiens |
| 5,083,815 | A | 1/1992 | Scrymgeour et al. |
| 5,092,598 | A | 3/1992 | Kamille |
| 5,094,458 | A | 3/1992 | Kamille |
| 5,100,139 | A | 3/1992 | Di Bella |
| 5,109,153 | A | 4/1992 | Johnsen et al. |
| 5,112,050 | A | 5/1992 | Koza et al. |
| 5,116,049 | A | 5/1992 | Sludikoff et al. |
| 5,118,109 | A | 6/1992 | Gumina |
| 5,119,295 | A | 6/1992 | Kapur |
| 5,158,293 | A | 10/1992 | Mullins |
| 5,165,967 | A | 11/1992 | Theno et al. |
| 5,186,463 | A | 2/1993 | Marin et al. |
| 5,189,292 | A | 2/1993 | Batterman et al. |
| 5,193,815 | A | 3/1993 | Pollard |
| 5,193,854 | A | 3/1993 | Borowski, Jr. et al. |
| 5,228,692 | A | 7/1993 | Carrick et al. |
| 5,232,221 | A | 8/1993 | Sludikoff et al. |
| 5,234,798 | A | 8/1993 | Heninger et al. |
| 5,249,801 | A | 10/1993 | Jarvis |
| 5,259,616 | A | 11/1993 | Bergmann |
| 5,273,281 | A | 12/1993 | Lovell |
| 5,276,980 | A | 1/1994 | Carter et al. |
| 5,282,620 | A | 2/1994 | Keesee |
| 5,308,992 | A | 5/1994 | Crane et al. |
| 5,317,135 | A | 5/1994 | Finocchio |
| 5,326,104 | A | 7/1994 | Pease et al. |
| 5,332,219 | A | 7/1994 | Marnell, II et al. |
| 5,342,047 | A * | 8/1994 | Heidel et al. ..... 463/29 |
| 5,342,049 | A | 8/1994 | Wichinsky et al. |
| 5,344,144 | A | 9/1994 | Canon |
| 5,346,258 | A | 9/1994 | Behn et al. |
| 5,380,007 | A | 1/1995 | Travis et al. |
| 5,393,057 | A | 2/1995 | Marnell, II et al. |
| 5,401,024 | A | 3/1995 | Simunek |
| 5,401,541 | A | 3/1995 | Hodnett, III |
| 5,403,039 | A | 4/1995 | Borowski, Jr. et al. |
| 5,407,199 | A | 4/1995 | Gumina |
| 5,420,406 | A | 5/1995 | Izawa et al. |
| 5,432,005 | A | 7/1995 | Tanigami et al. |
| 5,451,052 | A | 9/1995 | Behm et al. |
| 5,456,465 | A | 10/1995 | Durham |
| 5,456,602 | A | 10/1995 | Sakuma |
| 5,471,040 | A | 11/1995 | May |
| 5,475,205 | A | 12/1995 | Behm et al. |
| 5,486,005 | A | 1/1996 | Neal |
| 5,513,846 | A | 5/1996 | Niederlein et al. |
| 5,528,154 | A | 6/1996 | Leichner et al. |
| 5,536,016 | A | 7/1996 | Thompson |
| 5,540,442 | A | 7/1996 | Orselli et al. |
| 5,548,110 | A | 8/1996 | Storch et al. |
| 5,550,746 | A | 8/1996 | Jacobs |
| 5,560,610 | A | 10/1996 | Behm et al. |
| 5,564,700 | A | 10/1996 | Celona |
| 5,564,977 | A | 10/1996 | Algie |
| 5,591,956 | A | 1/1997 | Longacre, Jr. et al. |
| 5,599,046 | A | 2/1997 | Behm et al. |
| 5,602,381 | A | 2/1997 | Hoshino et al. |
| 5,621,200 | A | 4/1997 | Irwin et al. |
| 5,628,684 | A | 5/1997 | Bouedec |
| 5,630,753 | A | 5/1997 | Fuchs |
| 5,651,735 | A | 7/1997 | Baba |
| 5,655,961 | A | 8/1997 | Acres et al. |
| 5,667,250 | A | 9/1997 | Behm et al. |
| 5,682,819 | A | 11/1997 | Beaty |
| 5,690,366 | A | 11/1997 | Luciano |
| 5,704,647 | A | 1/1998 | Desbiens |
| 5,722,891 | A | 3/1998 | Inoue |
| 5,726,898 | A | 3/1998 | Jacobs |
| 5,732,948 | A | 3/1998 | Yoseloff |
| 5,741,183 | A | 4/1998 | Acres et al. |
| 5,743,800 | A | 4/1998 | Huard et al. |
| 5,752,882 | A | 5/1998 | Acres et al. |
| 5,756,220 | A | 5/1998 | Hoshino et al. |
| 5,768,142 | A | 6/1998 | Jacobs |
| 5,769,458 | A | 6/1998 | Carides et al. |
| 5,770,533 | A | 6/1998 | Franchi |
| 5,772,509 | A | 6/1998 | Weiss |
| 5,772,510 | A | 6/1998 | Roberts |
| 5,772,511 | A | 6/1998 | Smeltzer |
| RE35,864 | E | 7/1998 | Weingardt |
| 5,779,840 | A | 7/1998 | Boris |
| 5,789,459 | A | 8/1998 | Inagaki et al. |
| 5,791,990 | A | 8/1998 | Schroeder et al. |
| 5,797,794 | A | 8/1998 | Angell |

| | | | |
|---|---|---|---|
| 5,803,504 | A | 9/1998 | Deshiens et al. |
| 5,816,920 | A | 10/1998 | Hanai |
| 5,818,019 | A | 10/1998 | Irwin, Jr. et al. |
| 5,820,459 | A | 10/1998 | Acres et al. |
| 5,823,874 | A | 10/1998 | Adams |
| 5,830,063 | A | 11/1998 | Byrne |
| 5,830,066 | A | 11/1998 | Goden et al. |
| 5,830,067 | A | 11/1998 | Graves et al. |
| 5,833,537 | A | 11/1998 | Barrie |
| 5,835,576 | A | 11/1998 | Katz |
| 5,836,086 | A | 11/1998 | Elder |
| 5,836,817 | A | 11/1998 | Acres et al. |
| 5,848,932 | A | 12/1998 | Adams |
| 5,863,075 | A | 1/1999 | Rich et al. |
| 5,871,398 | A | 2/1999 | Schneier et al. |
| 5,876,284 | A | 3/1999 | Acres et al. |
| 5,882,261 | A | 3/1999 | Adams |
| 5,883,537 | A | 3/1999 | Luoni et al. |
| 5,885,158 | A | 3/1999 | Torango et al. |
| 5,887,906 | A | 3/1999 | Sultan |
| 5,903,340 | A | 5/1999 | Lawady et al. |
| 5,911,418 | A | 6/1999 | Adams |
| 5,915,588 | A | 6/1999 | Stoken et al. |
| 5,934,671 | A | 8/1999 | Harrison |
| 5,970,143 | A | 10/1999 | Shneier et al. |
| 5,979,894 | A | 11/1999 | Alexoff |
| 5,996,997 | A | 12/1999 | Kamille |
| 5,997,044 | A | 12/1999 | Behm et al. |
| 6,004,207 | A | 12/1999 | Wilson, Jr. et al. |
| 6,004,208 | A | 12/1999 | Takemoto et al. |
| 6,007,162 | A | 12/1999 | Hinz et al. |
| 6,012,982 | A | 1/2000 | Piechowiak et al. |
| 6,014,032 | A | 1/2000 | Maddix et al. |
| 6,017,032 | A | 1/2000 | Grippo et al. |
| 6,024,641 | A | 2/2000 | Sarno |
| 6,033,307 | A | 3/2000 | Vancura |
| 6,053,405 | A | 4/2000 | Irwin, Jr. et al. |
| 6,077,162 | A | 6/2000 | Weiss |
| 6,080,062 | A | 6/2000 | Olson |
| 6,086,477 | A | 7/2000 | Walker et al. |
| 6,089,978 | A | 7/2000 | Adams |
| 6,099,407 | A | 8/2000 | Parker, Jr. et al. |
| 6,102,400 | A | 8/2000 | Scott et al. |
| 6,107,913 | A | 8/2000 | Gatto et al. |
| 6,119,364 | A | 9/2000 | Elder |
| 6,125,368 | A | 9/2000 | Bridge et al. |
| 6,142,872 | A | 11/2000 | Walker et al. |
| 6,146,272 | A | 11/2000 | Walker et al. |
| 6,149,521 | A | 11/2000 | Sanduski |
| 6,155,491 | A | 12/2000 | Dueker et al. |
| 6,168,521 | B1 | 1/2001 | Luciano et al. |
| 6,168,522 | B1 | 1/2001 | Walker et al. |
| 6,179,710 | B1 | 1/2001 | Sawyer et al. |
| 6,203,430 | B1 | 3/2001 | Walker et al. |
| 6,206,373 | B1 | 3/2001 | Garrod |
| 6,210,275 | B1 | 4/2001 | Olsen |
| 6,217,448 | B1 | 4/2001 | Olsen |
| 6,220,961 | B1 | 4/2001 | Keane et al. |
| 6,224,055 | B1 | 5/2001 | Walker et al. |
| 6,227,969 | B1 | 5/2001 | Yoseloff |
| 6,238,288 | B1 | 5/2001 | Walker et al. |
| 6,309,300 | B1 | 10/2001 | Glavich |
| 6,312,334 | B1 | 11/2001 | Yoseloff |
| 6,315,291 | B1 | 11/2001 | Moody |
| 6,330,976 | B1 | 12/2001 | Dymetman et al. |
| 6,331,143 | B1 | 12/2001 | Yoseloff |
| 6,334,814 | B1 | 1/2002 | Adams |
| 6,340,158 | B1 | 1/2002 | Pierce et al. |
| 6,368,213 | B1 | 4/2002 | McNabola |
| 6,375,568 | B1 | 4/2002 | Roffman et al. |
| 6,379,742 | B1 | 4/2002 | Behm et al. |
| 6,394,899 | B1 | 5/2002 | Walker |
| 6,398,214 | B1 | 6/2002 | Moteki et al. |
| 6,398,643 | B1 | 6/2002 | Knowles et al. |
| 6,398,644 | B1 | 6/2002 | Perrie et al. |
| 6,398,645 | B1 | 6/2002 | Yoseloff |
| 6,416,408 | B1 | 7/2002 | Tracy et al. |
| 6,419,579 | B1 | 7/2002 | Bennett |
| 6,435,408 | B1 | 8/2002 | Irwin, Jr. et al. |
| 6,435,500 | B1 | 8/2002 | Gurnine |
| 6,478,677 | B1 | 11/2002 | Moody |
| 6,491,215 | B1 | 12/2002 | Irwin, Jr. et al. |
| 6,497,408 | B1 | 12/2002 | Walker et al. |
| 6,552,290 | B1 | 4/2003 | Lawandy |
| 6,588,747 | B1 | 7/2003 | Seelig |
| 6,599,186 | B1 | 7/2003 | Walker et al. |
| 6,601,772 | B1 | 8/2003 | Rubin et al. |
| 6,637,747 | B1 | 10/2003 | Garrod |
| 6,648,735 | B1 | 11/2003 | Miyashita et al. |
| 6,648,753 | B1 | 11/2003 | Tracy et al. |
| 6,648,755 | B1 | 11/2003 | Luciano et al. |
| 6,676,126 | B1 | 1/2004 | Walker et al. |
| 6,692,354 | B1 | 2/2004 | Tracy et al. |
| 6,702,047 | B1 | 3/2004 | Huber |
| 6,702,668 | B1 * | 3/2004 | Banyai ..... 463/17 |
| 6,773,345 | B1 | 8/2004 | Walker et al. |
| 6,776,337 | B1 | 8/2004 | Irwin, Jr. et al. |
| 6,786,824 | B1 | 9/2004 | Cannon |
| 6,823,874 | B1 | 11/2004 | Lexcen |
| 6,875,105 | B1 | 4/2005 | Behm et al. |
| 6,929,186 | B1 | 8/2005 | Lapstun |
| 2001/0027130 | A1 | 10/2001 | Namba et al. |
| 2001/0030978 | A1 | 10/2001 | Holloway et al. |
| 2001/0034262 | A1 | 10/2001 | Banyai |
| 2001/0040345 | A1 | 11/2001 | Au-Yeung |
| 2002/0022511 | A1 | 2/2002 | Eklund et al. |
| 2002/0084335 | A1 | 7/2002 | Ericson |
| 2002/0171201 | A1 | 11/2002 | Au-Yeung |
| 2002/0187825 | A1 | 12/2002 | Tracy et al. |
| 2003/0050109 | A1 | 3/2003 | Caro et al. |
| 2003/0114210 | A1 | 6/2003 | Meyer et al. |
| 2004/0076310 | A1 | 4/2004 | Hersch et al. |
| 2004/0173965 | A1 | 9/2004 | Stanek |
| 2004/0178582 | A1 | 9/2004 | Garrod |
| 2004/0185931 | A1 | 9/2004 | Hartman et al. |
| 2004/0204222 | A1 | 10/2004 | Roberts |
| 2004/0259631 | A1 | 12/2004 | Katz et al. |
| 2004/0266514 | A1 | 12/2004 | Penrice |

FOREIGN PATENT DOCUMENTS

| | | |
|---|---|---|
| AU | B-21070/92 | 7/1993 |
| AU | A-5037/96 | 2/1997 |
| AU | B-52499/96 | 2/1997 |
| AU | 199716432 B2 | 9/1997 |
| AU | A-45403/97 | 4/1998 |
| AU | A-63553/98 | 10/1998 |
| DE | 2938307 C2 | 4/1981 |
| DE | 3035898 A1 | 4/1982 |
| DE | 3035947 A1 | 5/1982 |
| DE | 2938307 C3 | 6/1982 |
| DE | 29803107 U1 | 8/1988 |
| DE | 3822636 A1 | 1/1990 |
| DE | 2938307 C3 | 8/1990 |
| DE | 3822636 A1 | 1/1992 |
| DE | 3415114 A1 | 10/1995 |
| DE | 19646956 C1 | 5/1998 |
| DE | 19706286 A1 | 5/1998 |
| DE | 29816453 U1 | 4/1999 |
| DE | 19751746 A1 | 5/1999 |
| EP | 529535 | 6/1983 |
| EP | 529536 | 6/1983 |
| EP | 0122902 B1 | 4/1984 |
| EP | 0333934 A1 | 9/1989 |
| EP | 0458623 | 11/1991 |
| EP | 0798676 A1 | 10/1997 |

| | | | |
|---|---|---|---|
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 9/1990 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO 02/056266 | A1 | 7/2002 |

OTHER PUBLICATIONS

'Beginner's Guide-How To Bet', (www.plimico.com/How+to+wager/beginnersguide/), (Internet Article), 3 Pgs.

Chip Brown, 'Austin American-Statesman', (Article), May 28, 1998, 2 Pgs., Texas.

John C. Hallyburton, Jr., 'Frequently Asked Questions About Keno', (Internet Article), 1995, 1998, 10 Pgs., (http://conielco.com/faq/keno.html).

'Horse betting Tutorial-Types of Bets' (www.homepokergames.com/horsebettingtutorial.php), (Internet Article), 2 Pgs.

Judith Gaines, 'Pool Party Betting Business Booming Throughout Area Workplaces'. (Internet Article), Mar. 19, 1994, 2 Pgs., Issue 07431791, Boston Globe, Boston MA.

'Maryland Launches Let It Ride', (Internet Article), Circa 2001, 1 Pg.

'Notice of Final Rulemaking', (Internet Article) Mar. 24, 2000, 10 Pgs., vol. 6, Issue#13, Arizona Administrative Register, Arizona.

'How To Play Megabucks', (Internet Article), Mar. 9, 2001, 2 Pgs., Oregon Lottery Megabucks,(http://www.oregonlottery.org/mega/m_howto.htm).

'How To Play Megabucks', (Internet Article), May 8, 2001, 2 Pgs., Oregon Lottery Megabucks, (http://www.oregonlottery.org/mega/m_howto.htm).

'Oregon Lottery', (Internet Article), Apr. 30, 2004, 9 Pgs., Oregon Lottery Web Center, (http://www.oregonlottery.org/general/g_hist.shtml).

'Powerball Odd & Prizes', 'How to Play Powerball', (Internet Article), Dec. 2002, 2 Pgs., (www.powerball.com/pbhowtoplay.shtm).

'Powerball Prizes and Odds', (Internet Article), 2 Pgs., http://www.powerball.com/pbprizesNOdds.shtm.

'Learn To Play the Races'(Internet Article), 15 Pgs., Racing Daily Form (www.drf.com).

Mike Parker, 'The History of Horse Racing' (Internet Article), 1996, 1997, 1998, 5 Pgs., http://www.mrmike.com/explore/hrhist.htm.

* cited by examiner

METHODS AND APPARATUS FOR PROVIDING A LOTTERY GAME

BACKGROUND

This patent is directed to a method for playing a lottery game that may include substituting a randomly occurring symbol for a lottery indicia, which could be performed by either an individual gaming unit or a gaming system having a plurality of gaming units, each gaming unit capable of providing the lottery game.

Conventional casino gaming units have provided lottery games including keno games. Government-sponsored lottery games have also been provided. With either the casino gaming unit or the government-sponsored lottery game, a player was able to select one or more game numbers from a range of game numbers which could be compared to one or more randomly selected game numbers. The randomly selected numbers represented the winning numbers for the lottery game. If there were a sufficient number of matches between the player's game numbers and the randomly selected numbers, the player would receive a payout.

Conventional gaming units have also provided other games, including poker and slots. In some of these gaming units, a poker card or a slot machine symbol was considered wild. That is, the wild poker card or wild slot machine symbol would represent any poker card or any slot machine symbol. The wild poker card or wild slot machine symbol was used to determine whether the player had a winning poker hand or a winning payline selection. Sometimes a slot machine symbol included a multiplier value to increase a value payout.

SUMMARY OF THE INVENTION

In one aspect, the invention may be directed to a gaming apparatus that may comprise a display unit, a value input device, and a controller operatively coupled to the display unit and the value input device. The display unit may be capable of generating video images. The controller may comprise a processor and a memory operatively coupled to the processor. The controller may be programmed to cause the display unit to display a video image of a keno game. The video image may comprise an image of keno numbers. The controller may be programmed to receive wager data representing a plurality of wagers, to randomly select a wager from the plurality of wagers, and to replace one or more person-selected keno numbers with a wild symbol. Each of the wagers may comprise one or more keno numbers selected by a person. The wild symbol may represent any of the plurality of keno numbers. The controller may also be programmed to randomly select one or more keno numbers from the plurality of keno numbers, to compare the person-selected keno numbers to the randomly selected keno numbers, to determine the wild symbol to match one or more of the randomly selected keno numbers, to determine whether a sufficient number of matches exist between the person-selected keno numbers and the randomly selected keno numbers, and to determine a value payout associated with an outcome of the game. The controller may further be programmed to randomly replace the one or more player-selected keno numbers with the wild symbol. The controller may be programmed to receive wager data representing a plurality of wagers from a plurality of persons, to select a person from the plurality of persons, and to replace one or more of the person-selected keno numbers of the selected person with the wild symbol. Each of the wagers may comprise one or more keno numbers selected by each of the persons from the plurality of keno numbers. The controller may be programmed to associate a multiplier factor with the randomly selected wager, and to multiply the value payout by the multiplier factor. The controller may also be programmed to randomly assigned a value to the multiplier and multiply the value payout by the randomly assigned value. The controller may further be programmed to randomly associate the multiplier factor with the wild symbol. A gaming system may comprise a plurality of gaming apparatuses interconnected to form a network, and the controller may be programmed to receive wager data representing at least one wager from each of the gaming apparatuses, to randomly select a gaming apparatus from the plurality of gaming apparatuses, and to replace one or more person-selected keno numbers of the randomly selected gaming apparatus with the wild symbol. The wager data may comprise one or more keno numbers selected by a person.

In another aspect, the invention may be directed to a gaming apparatus that may comprise a value input device, and a controller operatively coupled to the value input device. The controller may comprise a processor and a memory operatively coupled to the processor. The controller may be programmed to receive wager data in response to a wager made by a person on a game. The wager data may comprise a first subset of numbers selected by the person from a range of numbers. The controller may also be programmed to receive data representing a second subset of numbers randomly selected from the range of numbers, to replace one or more numbers in at least one of the first subset and the second subset with a non-numeric symbol representative of more than one number from the range of numbers, to randomly select a second subset of numbers from the range of numbers, to determine whether any of the numbers in the first subset match numbers in the second subset. The non-numeric symbol may match at least one number from the second subset if the non-numeric symbol replaces a number in the first subset, and the non-numeric symbol may match at least one number from the first subset if the non-numeric symbol replaced a number in the first subset. The controller may be programmed to determine a value payout associated with an outcome of the game.

The gaming apparatus may also comprise a display unit capable of generating video images. The controller may be operatively coupled to the display unit and may be programmed to cause a video image representing a game to be generated on the display unit, the video image may comprise the second subset. The video image may comprise a plurality of lottery numbers and may comprise the first subset including the non-numeric symbol. The controller may be programmed to randomly select the second subset from the plurality of numbers, make an automated selection of the first subset of numbers from among the range of numbers in response to an action by the person. The controller may be programmed to randomly replace the one or more numbers with the non-numeric symbol. The controller may be programmed to receive wager data representing a plurality of wagers each comprising a first subset of numbers selected by a person, to select a wager from the plurality of wagers, and to replace one or more numbers in the first subset of the selected wager with a non-numeric symbol. The controller may be programmed to randomly associate a multiplier factor with the wager, and to multiply the value payout by the multiplier factor. The controller may be programmed to randomly assign a value to the multiplier factors and multiply the value payout by the randomly assigned value. The controller may be programmed to randomly associate the multiplier factor with the non-numeric symbol. The controller may be programmed to issue a ticket voucher comprising the first subset of numbers and the non-numeric symbol. The controller may be programmed to receive wager data in response to wagers made by a plurality of persons, each wager comprising a first subset of numbers selected by a person from the range of numbers, to select a person from the plurality of persons, and to replace one or more numbers in the first subset of the selected person with the non-numeric symbol.

A gaming system may comprise a plurality of gaming apparatuses interconnected to form a network of gaming apparatuses. The controller may be programmed to receive wager data representing at least one wager from each of the gaming apparatuses, each wager comprising a first subset of number selected by a person, to select one or more of the plurality of gaming apparatuses, and to replace one or more numbers in the first subset of the one or more selected gaming apparatuses with the non-numeric symbol. The controller may comprise a central lottery controller and each of the gaming apparatuses may comprise a lottery terminal unit operatively coupled to said central controller. Each lottery terminal may comprise a ticket printer capable of generating ticket vouchers, and a terminal controller operatively coupled to the ticket printer. The terminal controller may comprise a processor and a memory operatively coupled to the processor. The terminal controller may be programmed to allow the person to make a wager, to allow the person to select the first subset of numbers from the range of numbers, to communicate the wager data to the central controller, and to cause the ticket printer to issue a ticket voucher which may comprise the first subset of numbers. The numbers may represent lottery numbers of a government-sponsored lottery game. The gaming apparatuses may be interconnected via the Internet.

In a further aspect, the invention may be directed to a gaming apparatus that may comprise a value input device, and a controller operatively coupled to the value input device. The controller may comprise a processor and a memory, and may be programmed to receive wager data in response to a wager made by a person on a game, where the wager data may comprise a first plurality of indicia of a first type selected by the person, to receive data representing a second plurality of indicia of the first type, where the second plurality of indicia of the first type may be randomly selected, to replace one or more of the indicia of a first type in at least one of the first plurality of indicia and the second plurality of indicia with an indicia of a second type, to determine whether any of the first plurality of indicia of the first type match any of the second plurality of indicia of the first type, to match the indicia of a second type with at least one of the second plurality of indicia of a first type if the indicia of a second type replaced an indicia of a first type from the first plurality of indicia, to match the indicia of a second type with at least one of the first plurality of indicia of a first type if the indicia of a second type replaced an indicia of a first type from the second plurality of indicia and to determine a value payout associated with an outcome of the lottery game.

The gaming apparatus may further comprise a display unit that is capable of generating video images, and the controller may be operatively coupled to said display unit. The controller may be programmed to cause a video image to be generated on said display unit. The video image may represent a lottery game. The video image may comprise a plurality of lottery numbers. The video image may comprise the first plurality of indicia of the first type and may not comprise the indicia of a second type, and the controller may be programmed to issue a ticket voucher which may comprise the first plurality of indicia of a first type and the indicia of a second type. The video image may comprise the first plurality of indicia of the first type including the indicia of the second type. The indicia of the first type may comprise lottery numbers.

The controller may be programmed to make an automated selection of the first plurality of indicia of a first type in response to an action by the person. The controller may be programmed to randomly select the second plurality of indicia of the first type. The controller may be programmed to randomly replace the one or more indicia of a first type with the plurality of indicia of a second type. The controller may be programmed to receive wager data representing a plurality of wagers, where each of the wagers may comprise a first plurality of indicia of a first type selected by a person, to select a wager from the plurality of wagers, and to replace an indicia from the first plurality of indicia of the first type of the selected wager with an indicia of the second type. The controller may be programmed to randomly associate a multiplier factor with the wager, and to multiply the value payout by the multiplier factor. The controller may be programmed to randomly assign a value to the multiplier factors and multiply the value payout by the randomly assigned value. The controller may be programmed to randomly associate the multiplier factor with the indicia of a second type. The controller may be programmed to receive wager data in response to wagers made by a plurality of persons, each wager comprising a first plurality of indicia of a first type selected by a person, to select a person from the plurality of persons, and to replace an indicia from the first plurality of indicia of a first type of the selected person with the indicia of a second type.

A gaming system may comprise a plurality of gaming apparatuses interconnected to form a network. The controller may be programmed to receive wager data representing at least one wager from each of the gaming apparatuses, each wager comprising a first plurality of indicia of a first type selected by a person, to select one or more of the plurality of gaming apparatuses, and to replace an indicia from the first plurality of indicia of a first type of the one or more selected gaming apparatuses with the indicia of a second type. The controller may comprise a central lottery controller and each of the gaming apparatuses may comprise a lottery terminal unit operatively coupled to said central controller. Each lottery terminal may comprise a ticket printer capable of generating ticket vouchers, and a terminal controller operatively coupled to the ticket printer. The terminal controller may comprise a processor and a memory operatively coupled to the processor. The terminal controller may be programmed to allow the person to make a wager, to allow the person to select the first plurality of indicia of a first type, to communicate the wager data to the central controller, and to cause the ticket printer to issue a ticket voucher which may comprise the first plurality of indicia of a first type. The plurality of indicia of a first type may represent lottery numbers of a government-sponsored lottery game. The gaming apparatuses may be interconnected via the Internet.

In yet another aspect, the invention may be directed to a gaming method that may comprise receiving wager data in response to a wager made by a person on a game, where the wager data may comprise a first plurality of indicia of a first type selected by the person; receiving data representing a second plurality of indicia of the first type, where the second plurality of indicia of the first type may be randomly selected; replacing one or more of the plurality of indicia of a first type from at least one of the first plurality of indicia and the second plurality of indicia with an indicia of a second type; determining whether any of the first plurality of indicia of the first type match any of said second plurality of indicia of the first type; matching the indicia of the second type with at least one of the second plurality of indicia of the first type if the indicia of a second type replaces an indicia of a first type from the first plurality of indicia; matching the indicia of the second type with at least one of the first plurality of indicia of the first type if the indicia of a second type replaces an indicia of a first type from the second plurality of indicia; and determining a value payout associated with an outcome of the game.

In yet a further aspect, the invention may be directed to a memory having a computer program stored therein. The computer program may be capable of being used in connection with a gaming apparatus. The memory may comprise a memory portion physically configured in accordance with computer program instructions that would cause the gaming apparatus to receive wager data in response to a wager made by a person on a game, where the wager data may comprise a first plurality of indicia of a first type selected by the person; a memory portion physically configured in accordance with computer program instructions that would cause the gaming apparatus to receive data representing a second plurality of indicia of the first type, where the second plurality of indicia of the first type may be randomly selected; a memory portion physically configured in accordance with computer program instructions that would cause the gaming apparatus to replace one or more of the of indicia of the first type in at least one of the first plurality of indicia and the second plurality of indicia with an indicia of a second type; a memory portion physically configured in accordance with computer program instructions that would cause the gaming apparatus to determine whether any of the first plurality of indicia of the first type match any of the second plurality of indicia of the first type; a memory portion physically configured in accordance with computer program instructions that would cause the gaming apparatus to match the indicia of the second type with at least one of the second plurality of indicia of the first type if the indicia of a second type replaced an indicia of a first type from the first plurality of indicia; a memory portion physically configured in accordance with computer program instructions that would cause the gaming apparatus to match the indicia of the second type with at least one of the first plurality of indicia of the first type if the indicia of a second type replaced an indicia of a first type from the second plurality of indicia; and a memory portion physically configured in accordance with computer program instructions that would cause the gaming apparatus to determine a value payout associated with an outcome of the game.

In a still further aspect, the invention may be directed to a government-sponsored lottery gaming system that may comprise a plurality of lottery terminals and a lottery controller operatively coupled to each of the plurality of lottery terminals. Each of the lottery terminals may comprise a ticket printer capable of generating ticket vouchers, a value input device and a terminal controller. The terminal controller may be operatively coupled to the ticket printer and the value input device, and may comprise a processor and a memory operatively coupled to the processor. The terminal controller may be programmed to allow a person to make a wager, to allow the person to select a first plurality of indicia of a first type, to communicate wager data to the lottery controller and to cause the ticket printer to issue a ticket voucher. The wager data may comprise the first plurality of indicia of a first type. The ticket voucher may comprise the first plurality of indicia of a first type. The lottery controller may comprise a processor and a memory operatively coupled to the processor and may be programmed to receive the wager data from each of the lottery terminals, to receive data representing a second plurality of indicia of the first type, to replace one or more the indicia of a first type from the first plurality of indicia, to determine whether any of the first plurality of indicia of a first type match any of the second plurality of indicia of a first type, to match the indicia of a second type with at least one of the second plurality of indicia of a first type, and to determine a value payout associated with an outcome of the game. The second plurality of indicia of the first type may be randomly selected.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
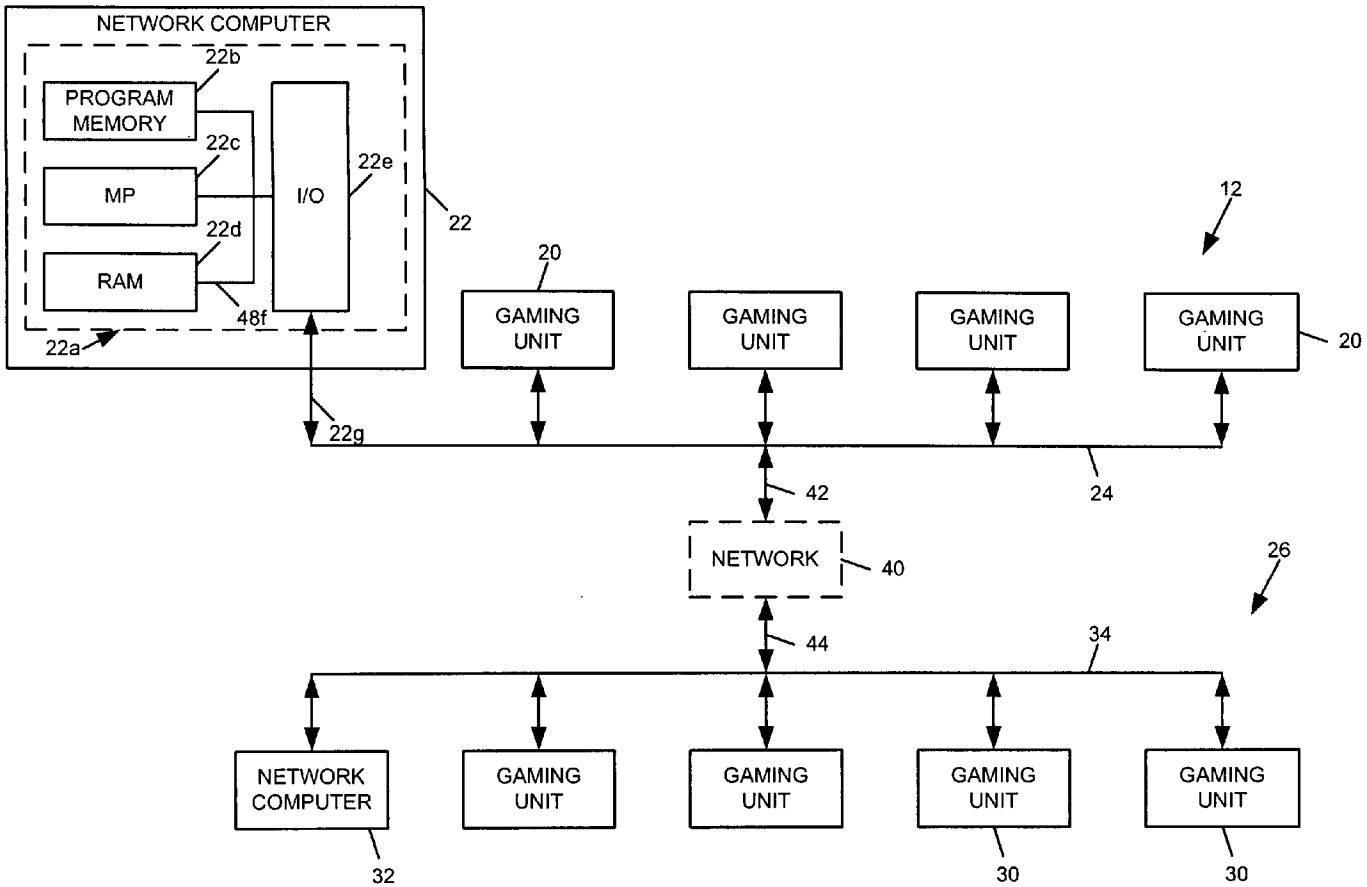
FIG. 1 is a block diagram of an embodiment of a gaming system in accordance with the invention.

FIG. 1 illustrates one possible embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

The network computer 22 may include a controller 22*a* that may comprise a program memory 22*b*, a microcontroller or microprocessor (MP) 22*c*, a random-access memory (RAM) 22*d* and an input/output (I/O) circuit 22*e*, all of which may be interconnected via an address/data bus 22*f*. It should be appreciated that although only one microprocessor 22*c* is shown, the controller 22*a* may include multiple microprocessors 22*c*. Similarly, the memory of the controller 22*a* may include multiple RAMs 22*d* and multiple program memories 22*b*. Although the I/O circuit 22*e* is shown as a single block, it should be appreciated that the I/O circuit 22*e* may include a number of different types of I/O circuits. The RAM(s) 22*d* and program memories 22*b* may be implemented as semiconductor memories, magnetically readable memories, and/or optically readable memories, for example.

Although the program memory 48*b* is shown in FIG. 1 as a read-only memory (ROM) 22*d*, the program memory of the controller 22*a* may be a read/write or alterable memory, such as a hard disk. In the event a hard disk is used as a program memory, the address/data bus 22*f* shown schematically in FIG. 1 may comprise multiple address/data buses, which may be of different types, and there may be an I/O circuit disposed between the address/data buses. The I/O circuit 22*e* may be coupled to the network 12 via a data link 22*g*. The network computer 32 may likewise include a controller similar to the controller 22*a* for the network computer 22.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may be provided as a dedicated hardwired link or a wireless link. Although the data link 24 is shown as a single data link 24, the data link 24 may comprise multiple data links.

Figure 2:
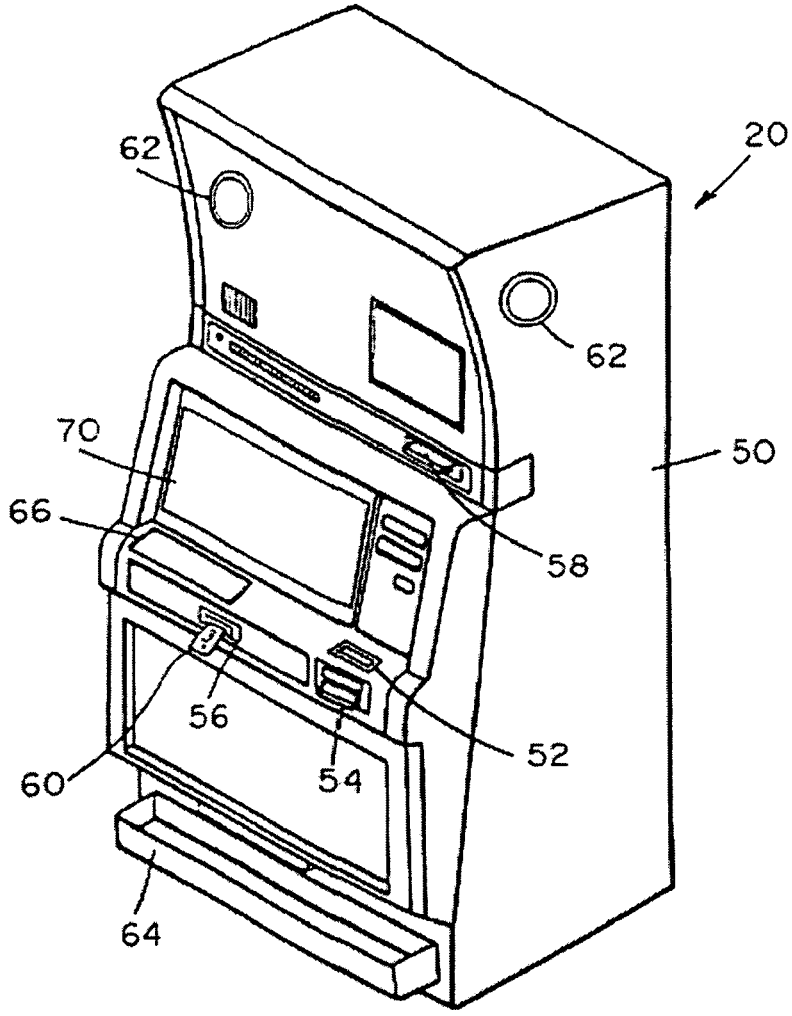
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, smart cards, and any other object representative of value.

If provided on the gaming unit 20, the ticket reader/printer 56 may be used as a cashless payout device to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, information concerning a player's gaming decisions, information concerning a player's wagers, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may also be used as a cashless payout device and may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, information concerning the player's gaming decisions, information concerning the player's wagers, etc. The card reader 58 may also be used to write data onto the player tracking card that is similar to data encoded on a ticket voucher 60, including the casino name, a validation number for a wager, security and/or control data, date and time of a wager, player gaming decisions, wager information, etc. The card reader 58 may further write data relating to redemption instructions and restrictions for a particular game, and a description of a possible award which may be read by the card reader 58 and displayed on the display unit 70. Additional cashless payout devices may include devices that communicate with the gaming unit 20 via radiowave or optical waves, such as infrared. The gaming unit 20 and the device, which may be portable and personal to the player, may exchange information similar to that printed or encoded on the ticket voucher 60 or the card described above.

The gaming unit 20 may include one or more audio speakers 62, a coin payout tray 64, an input control panel 66, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

Figure 2A:
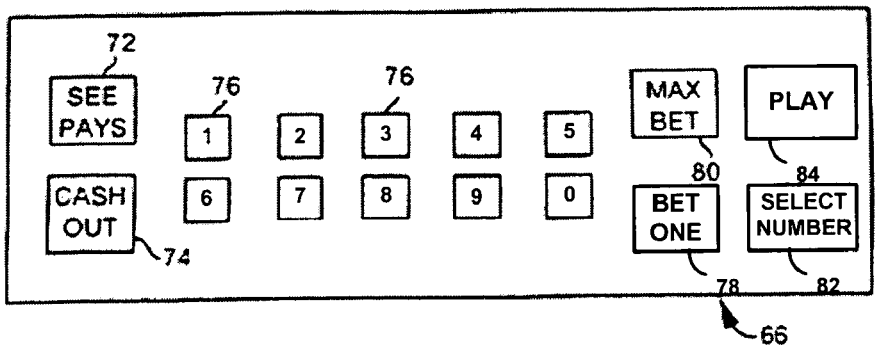
FIG. 2A illustrates an embodiment of a control panel for a gaming unit.

FIG. 2A illustrates one possible embodiment of the control panel 66, which may be used where the gaming unit 20 is a lottery machine having a plurality of numbers selected by the player and a plurality of numbers randomly selected during the lottery game. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a lottery game having a plurality of numbers selected by the player and a plurality of randomly selected numbers which define the winning set of numbers, the control panel 66 may be provided with a plurality of selection buttons 76, each of which allows the player to select a different number prior to randomly selecting the winning numbers. For example, a plurality of buttons 76 may be provided, each of which may allow a player to select any of the numbers from within a range of numbers.

The control panel 66 may be provided with a plurality of selection buttons 78, 80 each of which allows a player to specify a wager amount for each set of selected numbers. For example, if the smallest wager accepted by the gaming unit 20 is a quarter ($0.25), the gaming unit 20 may be provided with a "Bet One" selection button 78, which may allow a player to select one quarter to wager for each set of selected numbers. In that case, if a player were to select five sets of numbers using the plurality of buttons 76 (meaning that five sets of numbers were to be played on the next random selection of numbers) and then activate the "Bet One" button 78 (meaning that one coin per set of selected numbers was to be wagered), the total wager would be $1.25 (assuming the minimum bet was $0.25). Additional selection buttons may be made available to allow the player to specify various wagers between the minimum and maximum allowable wagers.

The control panel 66 may include a "Max Bet" button 80 to allow a player to make the maximum wager allowable for a game. For example, if the maximum allowable wager accepted by the gaming unit 20 is five quarters ($1.25) for each set of selected numbers and up to five set of numbers are selected, the maximum wager would be 25 quarters, or $6.25. The control panel 66 may include a "Select Number" button 82 to allow the player to enter a desired number using selection buttons 76 and have the number added to the set of selected numbers using the "Select Number" button 82. The control panel 66 may also include a "Play" button 84 to allow the player to initiate play of the lottery game (e.g., random selection of the wining numbers) after a set of numbers has been selected and a wager has been made.

In FIG. 2A, a rectangle is shown around the buttons 72, 74, 76, 78, 80, 82, 84. It should be understood that that rectangle simply designates, for ease of reference, an area in which the buttons 72, 74, 76, 78, 80, 82, 84 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3:
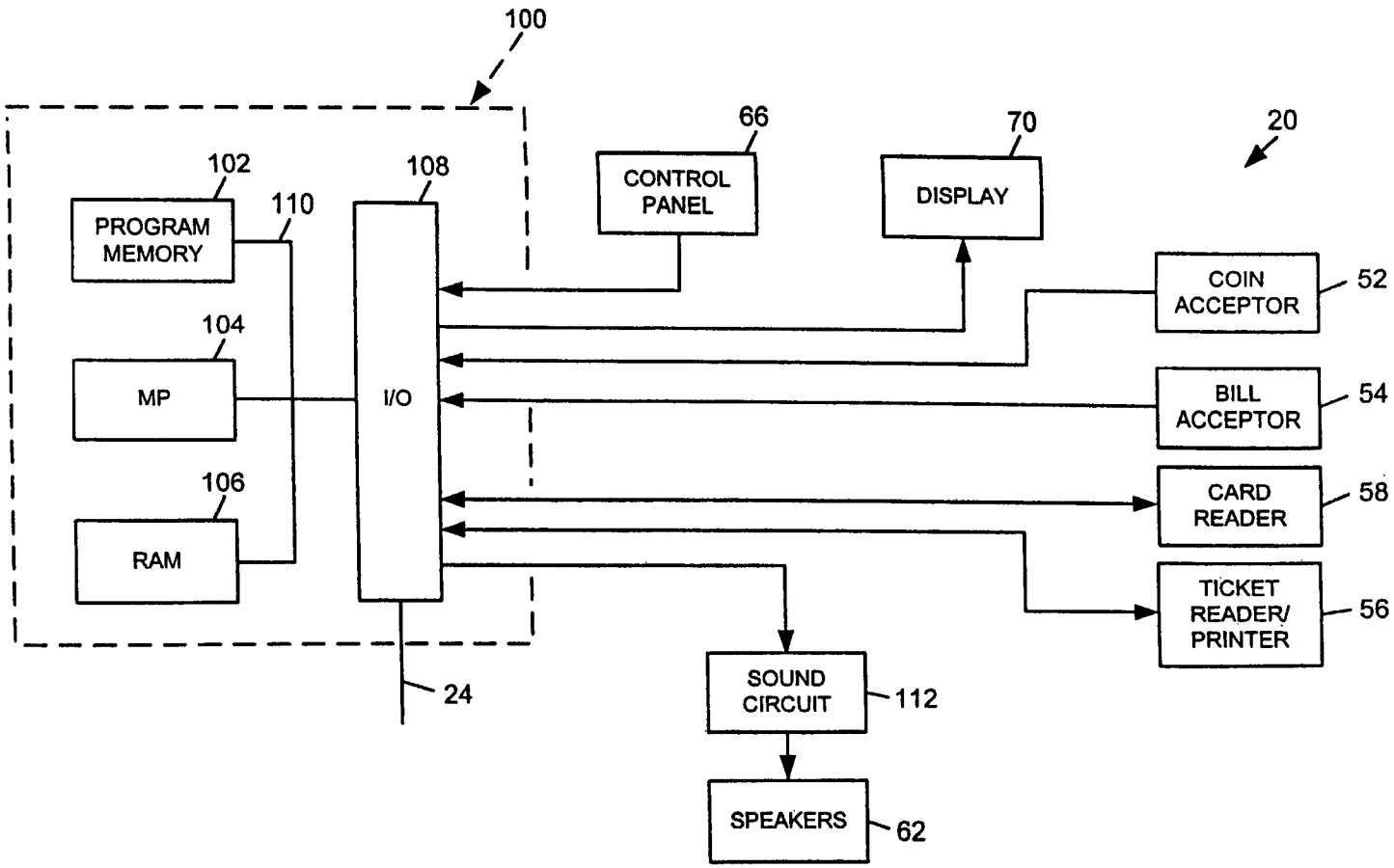
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

Although the program memory 102 is shown in FIG. 3 as a read-only memory (ROM) 102, the program memory of the controller 100 may be a read/write or alterable memory, such as a hard disk. In the event a hard disk is used as a program memory, the address/data bus 110 shown schematically in FIG. 3 may comprise multiple address/data buses, which may be of different types, and there may be an I/O circuit disposed between the address/data buses.

FIG. 3 illustrates that the control panel 66, the coin acceptor 52, the bill acceptor 54, the card reader 58, the ticket reader/printer 56 and the display unit 70 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3, the components 52, 54, 56, 58, 66, 70, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

In an alternative example to what is shown in FIG. 3, some or all of the components 52, 54, 56, 58, 66, 70, 112 and the controller 100 may be included with the gaming unit 20, the network computer 22, and/or the network 40. For example, each gaming unit 20 may include the control panel 66, the coin acceptor 52, the bill acceptor 54, the card reader 58 and the ticket reader/printer 56, whereas the display unit 70 may be provided as a unit separate from the gaming unit 20 and made viewable by multiple players on the first network 12 of gaming units 20. The same or different display unit 70 may then be made viewable by one or more players on the second network 26 of gaming units 30. In effect, each player may be provided with their own control panel 66, coin acceptor 52, bill acceptor 54, card reader 58 and ticket reader/printer 56 from which to select a set of numbers and make a wager. The card reader 58 and/or ticket reader/printer 56 may provide a ticket voucher 60 or player tracking card with the player's selected set of numbers printed and/or encoded thereon. The player's wager may also be encoded or printed on the ticket voucher 60 or player tracking card. The randomly selected numbers, which may be selected by the controller 100 or the controller 22*a*, may be displayed on the display unit 70 for each player to see.

In yet another alternative example, multiple players may use the same gaming unit to select a set of numbers and make a wager. The memory 102, 104, may store each player's selected numbers and wagers. The card reader 58 or ticket reader/printer 56 may print, encode or otherwise issue a ticket voucher 60 or player tracking card to each player with that player's selected set of numbers. The ticket voucher 60 or player tracking card may further include the amount of the player's wager. If a player happens to receive a payout, the player may offer the ticket voucher 60 or player tracking card to the ticket reader/printer 56 or card reader 58 to read. The controller 100 may then determine a payout to be made to the player and dispense the value or electronically deposit funds to the player's account. Alternatively, the ticket voucher 60 or player tracking card may be provided to an attendant who verifies the ticket voucher 60 or player tracking card and dispenses the payout or deposits funds to an account.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controllers 22*a*, 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C++, C#, Java or the like or any low-level assembly or machine language. By storing the computer program portions therein, various portions of the memories 22*b*, 22*c*, 102, 106 are physically and/or structurally configured in accordance with computer program instructions. While the following descriptions of routines may be described as being stored and/or executed by the controller 100, all or part of these routines may be stored and/or executed in the controller 22*a*.

Figure 4:
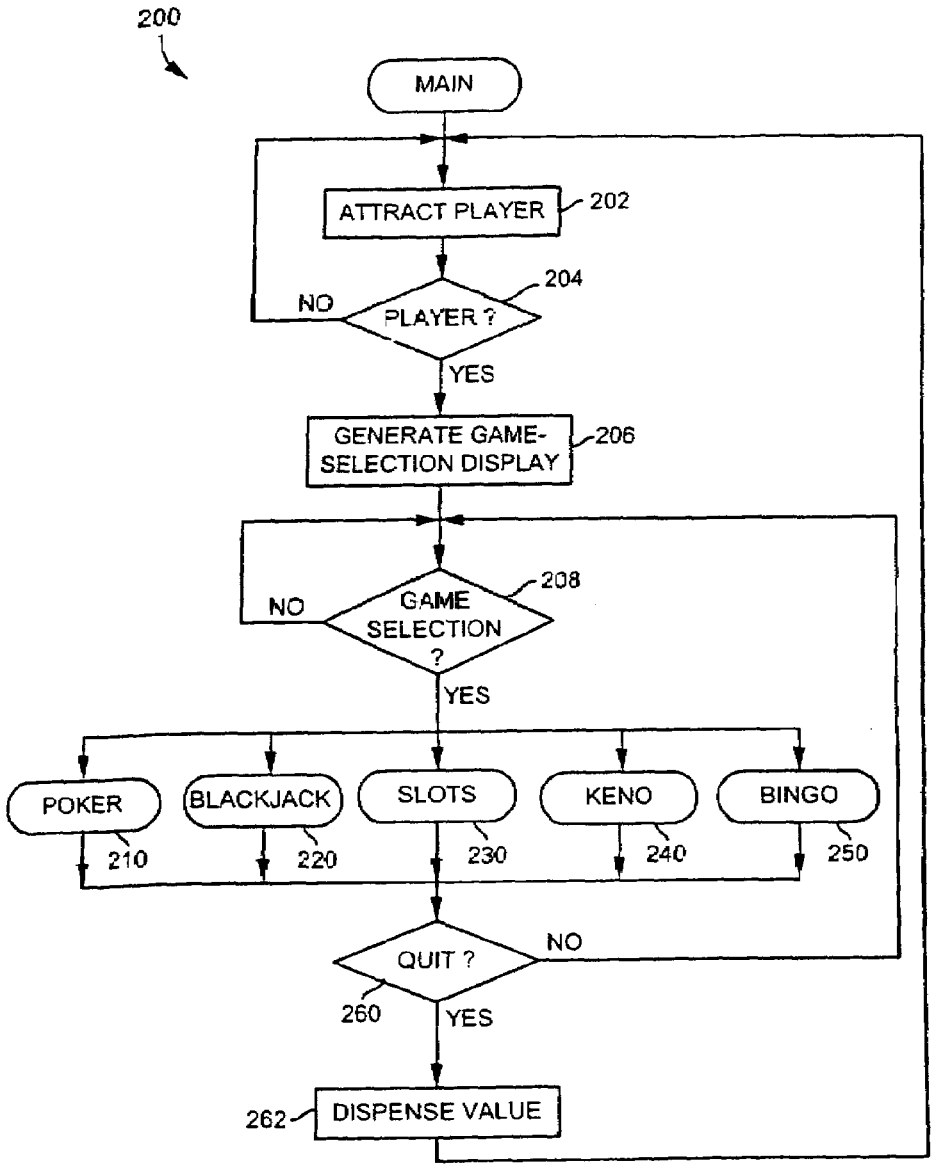
FIG. 4 is a flowchart of an embodiment of a main routine that may be performed during operation of one or more of the gaming units.

FIG. 4 is a flowchart of a main operating routine 200 that may be stored in the memory of the controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc. Alternatively or in combination, various types of lottery games may be displayed.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 210, a video blackjack routine 220, a slots routine 230, a video keno routine 240 (or various other video lottery routines), and a video bingo routine 250. At block 208, if no game selection is made within a given period of time, the operation may branch back to block 202.

After one of the routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games. For example, the video keno routine 240 may be replaced with any other type of lottery game.

Figure 5:
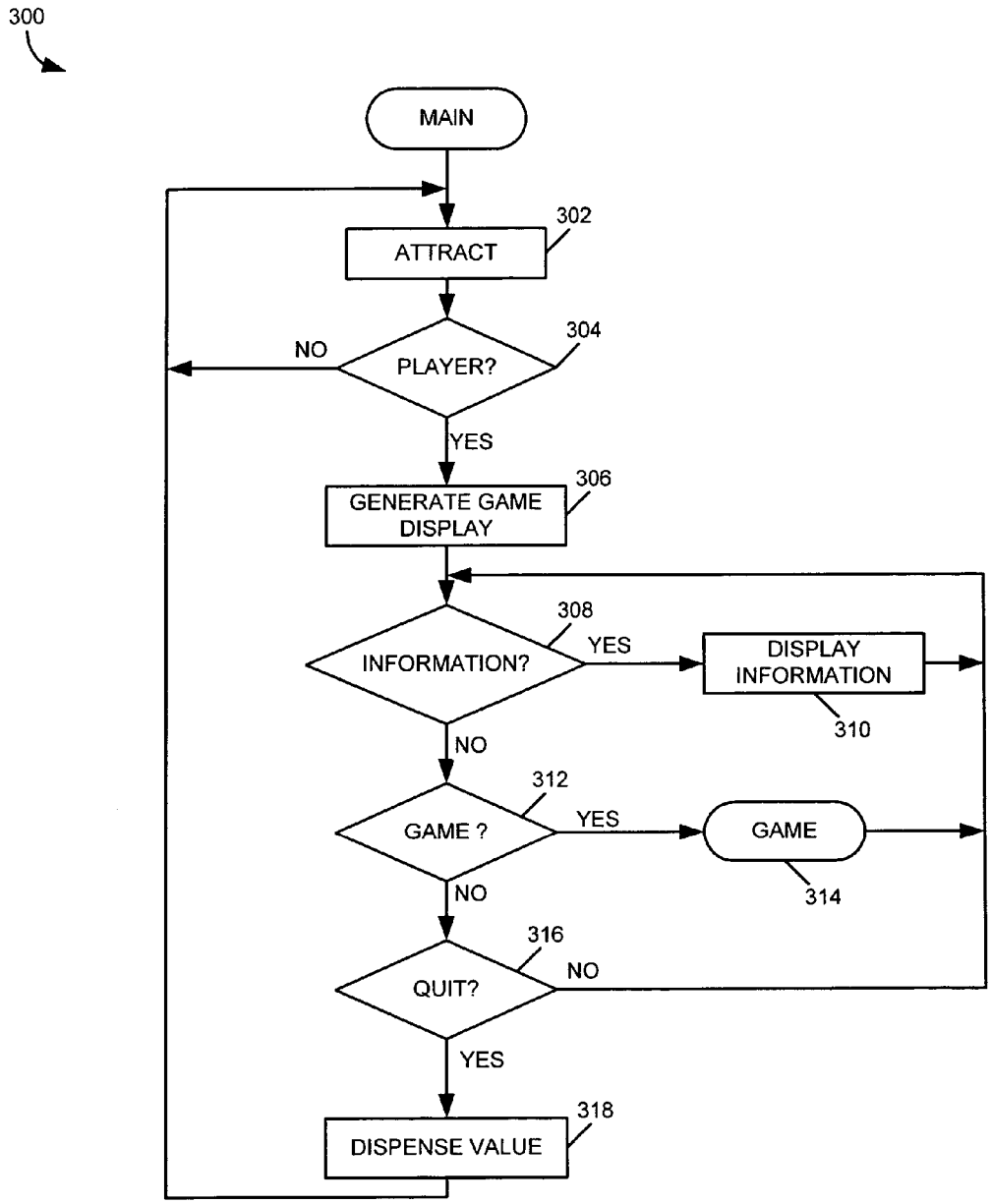
FIG. 5 is a flowchart of an alternative embodiment of a main routine that may be performed during operation of one or more of the gaming units.

FIG. 5 is a flowchart of an alternative main operating routine 300 that may be stored in the memory of the controller 100. The main routine 300 may be utilized for gaming units 20 that are designed to allow play of only a single game or single type of game. Referring to FIG. 5, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 314 may be performed. The game routine 314 could be any one of the game routines disclosed herein, such as one of the five game routines 210, 220, 230, 240, 250, or another game routine.

After the routine 314 has been performed to allow the player to play the game, block 316 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 318 based on the outcome of the game(s) played by the player. The operation may then return to block 302. If the player did not wish to quit as determined at block 316, the operation may return to block 308.

Video Keno

Figure 6:
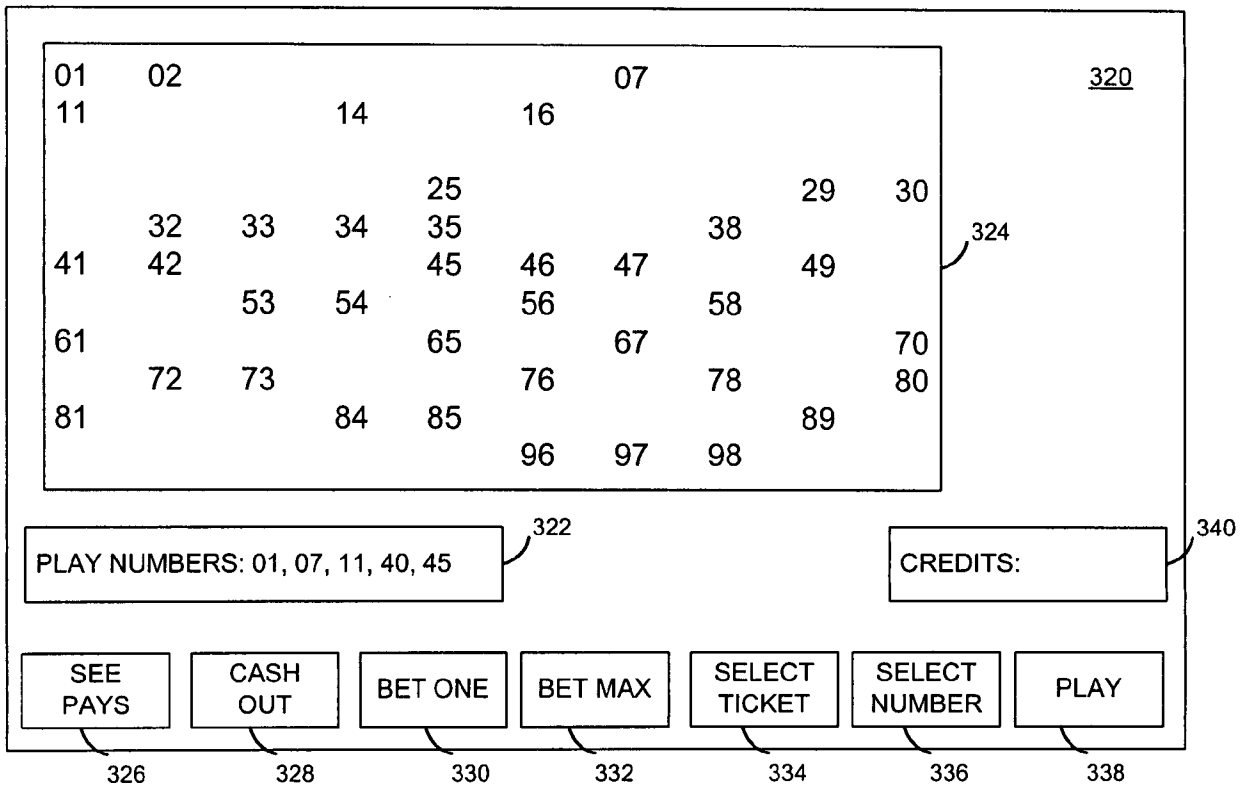
FIG. 6 is an illustration of an embodiment of a visual display that may be displayed during performance of the video keno routine of FIG. 9.

FIG. 6 is an exemplary display 320 that may be shown on the display unit 70 during performance of the video keno routine 240 shown schematically in FIG. 4. However, as mentioned above, any lottery game may be used in place of the video keno routine 240, though much of the display 320 and routine 240 are equally applicable to both video keno in particular and to other video lottery games in general. Hence, reference to a keno game as described herein should not be construed as limiting the claims thereto, but rather is intended only as an example of a lottery game that may be employed. Referring to FIG. 6, the display 320 may include a video image 322 of a plurality of numbers that were selected by the player prior to the start of a keno game and a video image 324 of a plurality of numbers randomly selected during the keno game by the controller 100. The controller-selected numbers may be displayed in a grid pattern. As an alternative to numbers, various other types of indicia may be used to depict the player-selected indicia and the controller-selected indicia. For example, the player may select a plurality of letters that are displayed as the video image 322, and the controller-selected indicia may also be letters which are displayed as the video image 324. Other possible types of indicia displayed as video images 322, 324 include cartoon figures, items of food, items of currency, etc. While virtually any indicia of a particular type may be used, for ease of explanation reference is made to numbers as being the type of indicia used in a video lottery game.

To allow the player to control the play of the keno game, a plurality of player-selectable buttons may be displayed. The buttons may include a "Cash Out" button 326, a "See Pays" button 328, a "Bet One Credit" button 330, a "Bet Max Credits" button 332, a "Select Ticket" button 334, a "Select Number" button 336, and a "Play" button 338. The display 320 may also include an area 340 in which the number of remaining credits or value is displayed. If the display unit 70 is provided with a touch-sensitive screen, the buttons may form part of the video display 320. Alternatively, one or more of those buttons may be provided as part of a control panel that is provided separately from the display unit 70. For example, in some keno or other lottery games, the display unit 70 is a large display available for public view. The control panel may also be available to the public, wherein each player inputs their selected numbers using the control panel and receives a ticket voucher 60. The winning numbers may then be displayed on the display unit 70.

Figure 7:
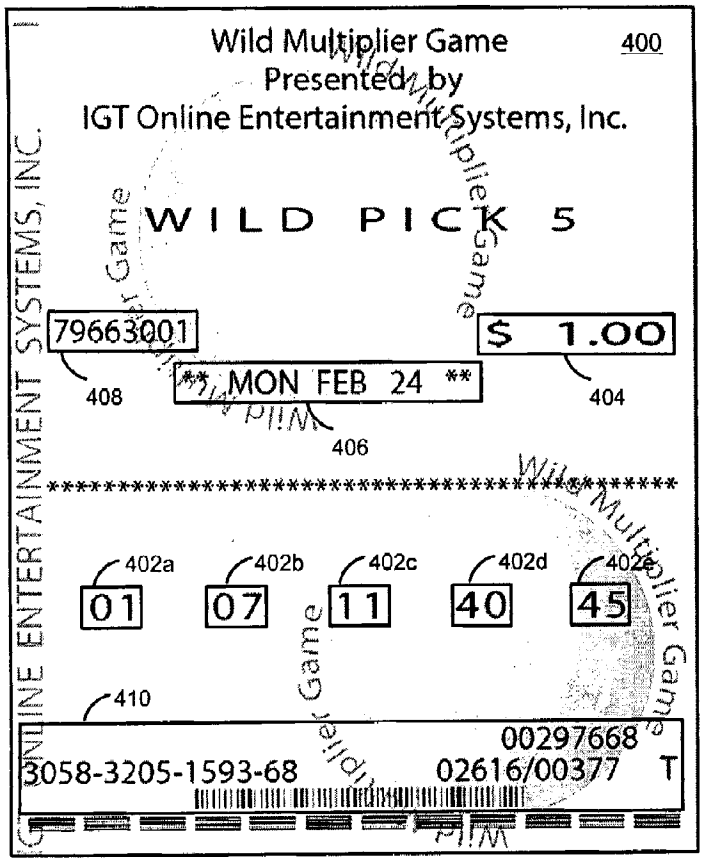
FIG. 7 is an illustration of an embodiment of a visual display that may be displayed during performance of the video keno routine of FIG. 9.

FIG. 7 is an exemplary display 400 that may be shown on the display unit 70 during performance of the video keno routine 240 shown schematically in FIG. 4. The display 400 may be shown in conjunction with the display 320 of FIG. 6. Alternatively, the display 400 may be printed on a ticket voucher 60. The display 400 may include an image 402*a*–402*e* of a plurality of numbers that were selected by the player prior to the start of a keno game. Additional images such as an image 404 of the amount of the player's wager and an image of the date 406 and/or time may be displayed. To provide validation for the ticket voucher, various information may be printed thereon such as a player identification number 408, or other unique identification information 410, such as serial numbers, barcodes, etc. This identification information may be used to uniquely identify the gaming unit 20 and/or casino from which the ticket voucher 60 was printed, uniquely link the ticket voucher 60 to the particular keno game and/or particular round of the keno game. The player identification number 408 and unique identification information 410 may thereby protect against forgery and theft of a winning ticket voucher 60.

Figure 8:
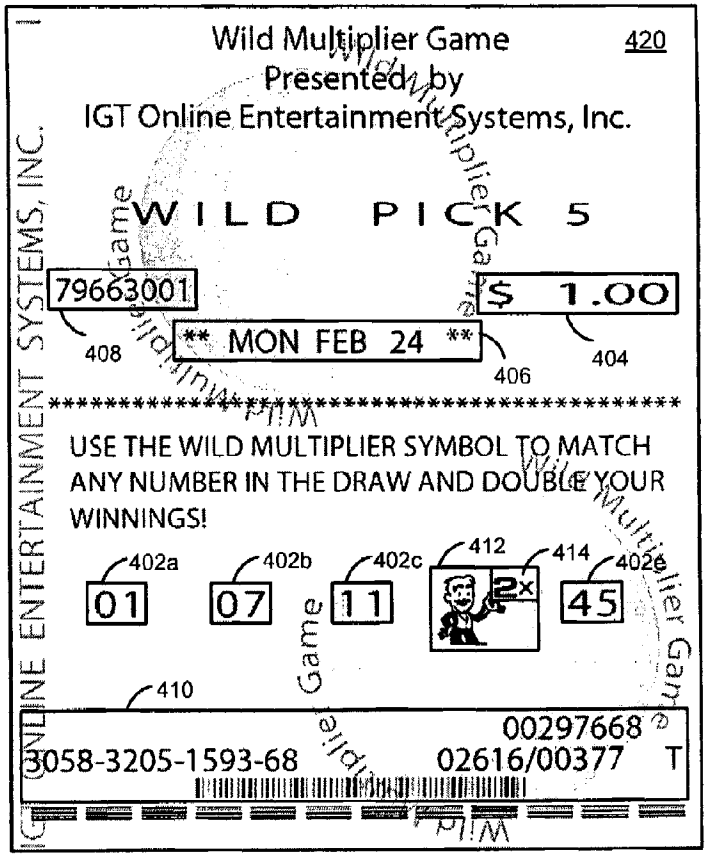
FIG. 8 is n illustration of an embodiment of a visual display that may be displayed during performance of the video keno routine of FIG. 9.

FIG. 8 is an exemplary display 420 which is a variation of the exemplary display 400 shown in FIG. 7. The display 420 may be displayed on a display unit 70 and/or printed on a ticket voucher 60. In one example, the display 400 shown in FIG. 7 is displayed on a display unit 70 whereas the display 420 of FIG. 8 is printed on a ticket voucher 60. Alternatively, the display unit 70 may initially show the display 400 and subsequently show the display 420. As with the display 400, the display 420 may include an image 404 of the amount of the player's wager and an image of the date 406 and/or time, a player identification number 408, unique identification information 410, etc. The display 420 further includes the player-selected numbers 402*a*–402*c*, 402*e*, though a randomly occurring symbol 412 has replaced one of the player-selected numbers 402*d*.

The randomly occurring symbol 412 used to replace the player-selected number 402*d* may be any type of indicia other than the type of indicia used for the player-selected indicia and for the controller-selected indicia. In FIG. 8, a player-selected number 402*d* has been replaced with a cartoon figure, where the cartoon figure represents the randomly occurring symbol 412. Preferably, the chosen type of indicia for the randomly occurring symbol 412 is readily distinguishable from a number, or whatever other type of indicia is being used for the player-selected and controller-selected indicia. For example, if the type of indicia are numbers, the randomly occurring symbol 412 may be a letter, a picture or other non-numeric symbol which would be readily distinguishable from the player-selected numbers and/or the controller-selected numbers.

However, it will be understood by those of ordinary skill in the art that in some examples the randomly occurring symbol 412 may be a particular number as opposed to a non-numeric indicia. For example, the player may select any number from the range of 1–100 other than the number '7', wherein the number '7' is the randomly occurring symbol 412. The controller-selected numbers may also be selected from the range of 1–100, not including '7'. In other words, the type of indicia used for the player-selected indicia and the controller-selected indicia is not merely numbers, but rather numbers other than '7' within the range of 1–100. Thus, the types of indicia may be defined merely by designating a particular symbol, whether it be alphanumeric or not, as a randomly occurring symbol 412. The particular randomly occurring symbol 412 may also be randomly determined. For example, various types of fruits may be used to represent various randomly occurring symbols 412, and the type of fruit may be determined randomly.

Additionally, more than one possible randomly occurring symbol 412 may be used to replace any of the player-selected numbers 402*a*–402*e*. For example, the randomly occurring symbol 412 may be any number from the range of 0–9, and the player may be allowed to select any number from 10–100. The numbers selected by the controller 100 may also be selected from the range of 10–100. The range of numbers 0–9 may thereby represent a type of indicia different from the range of numbers 10–100 which may be used to select the player-selected numbers and the controller-selected numbers. Multiple player-selected numbers 402*a*–402*e* may be randomly replaced by any of the randomly occurring symbols 412 (e.g., numbers 0-9). The number of randomly occurring symbols 412 may also be random such that all or none of the player-selected indicia 402*a*–402*e* may be replaced with a randomly occurring symbol 412. Therefore, it is possible for the player to win with any set of numbers, no matter what numbers are selected by the controller 100. Moreover, the randomly occurring symbol 412 is not limited to replacing only player-selected indicia. In one example, the randomly occurring symbol 412 may be used to replace one or more of the controller-selected indicia. Depending on the form of the game, this may mean that some or all of the players playing the lottery game win, or only one player wins, as would be the case with a video lottery game localized to only one gaming unit such that only one player may play at a time.

The randomly occurring symbol 412 may be representative of any of the possible indicia chosen by the player or the controller 100. In other words, the randomly occurring symbol 412 is "wild". For example, if the player-selected numbers 402*a*–402*e* and the controller-selected numbers are selected from the range of 1–100, the randomly occurring symbol 412 may represent any number from 1–100. Referring again to FIGS. 7 and 8, the player-selected numbers 402*a*–402*e* comprise 1, 7, 11, 40 and 45, where the number '40' has been replaced with the randomly occurring symbol 412 as shown in FIG. 8. Subsequently, the controller 100 may randomly select numbers from 1–100 which represent winning numbers. Among the controller-selected numbers are 1, 7, 11 and 45 as seen in the video image 324 of FIG. 6. The number '40' has not been selected by the controller 100. However, the randomly occurring symbol 412 represents any of the numbers selected by the controller 100, so the player-selected numbers 402*a*–402*c*, 402*e*, which now includes the randomly occurring symbol 412, are determined to be a match with the numbers chosen by the controller 100. In other words, the randomly occurring symbol 412 is considered a match with any controller-selected number.

Also shown in FIG. 8 is a multiplier symbol, which may be displayed as a video image 414 or printed on a ticket voucher 60 as a printed image 414. As shown in FIG. 8, the multiplier symbol 414 is displayed as being part of the image associated with the randomly occurring symbol 412. The multiplier symbol 414 may signify a bonus in the amount awarded to the player, should there be a sufficient degree of match between the player-selected numbers and the controller-selected numbers so as to cause a payout to occur. In the example of FIG. 8, the multiplier symbol 414 has a multiplier factor of '2' and a sufficient degree of match between the player-selected numbers and controller-selected numbers would double any payout the player may receive. Therefore, because the player-selected numbers (including the randomly occurring symbol 412) match some of the controller-selected numbers, the player would receive twice the normal payout associated with such a match. The occurrence of the multiplier image 414 may also be random, such that in some instances the randomly occurring symbol 412 may be displayed with the multiplier image 414 and in other instances the randomly occurring symbol 412 may not include the multiplier image 414. In the latter instances, the randomly occurring symbol 412 may still represent any number selected by the controller 100, but the payout remains the same for the outcome. Alternatively, the multiplier image 414 may be randomly displayed without the randomly occurring symbol 412. The amount of the multiplier factor may likewise be random. The amount of the multiplier factor may also be dependent on the particular randomly occurring symbol 412 that is displayed.

Figure 9:
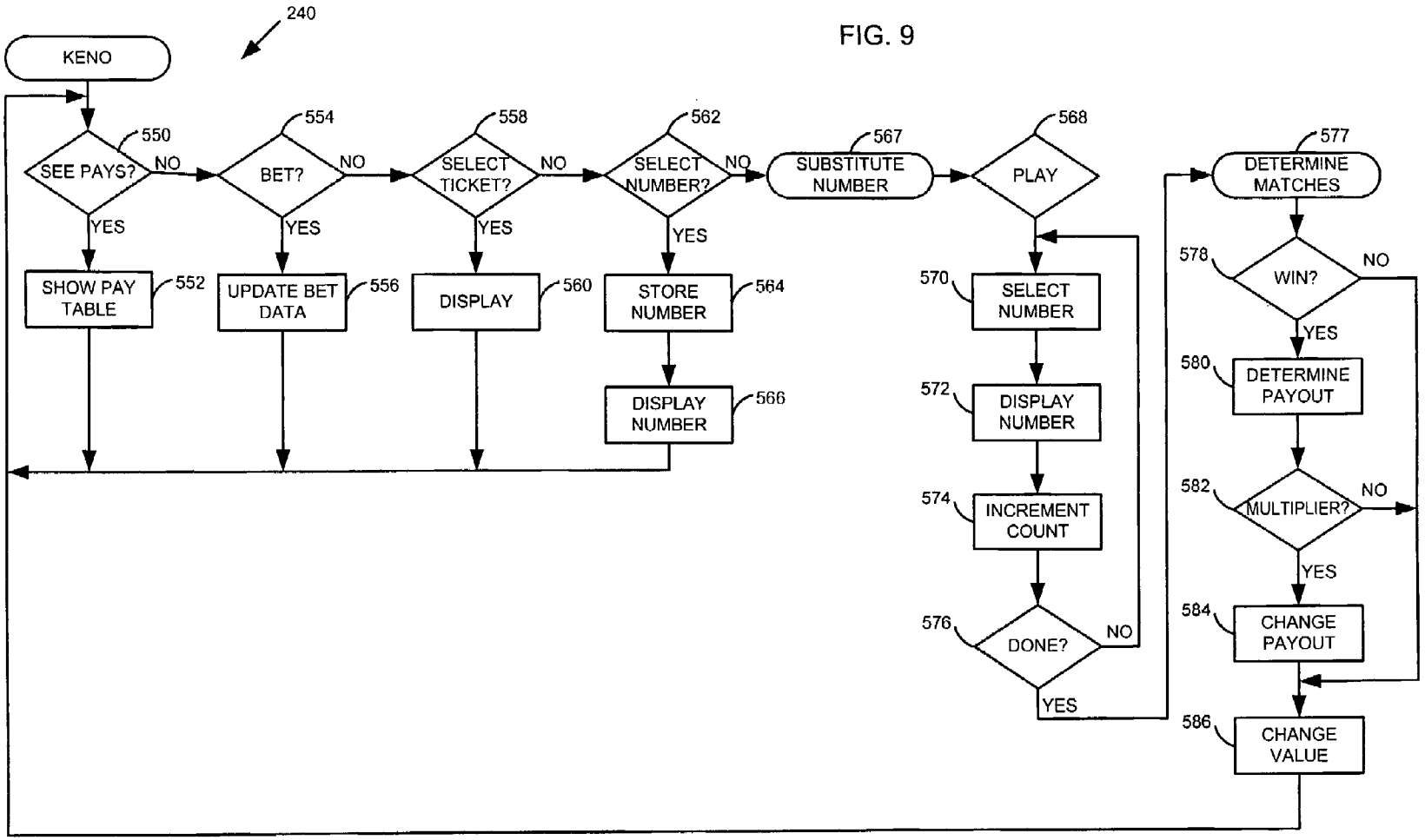
FIG. 9 is a flowchart of an embodiment of a video keno routine that may be performed by one or more of the gaming units.

FIG. 9 is a flowchart of the video keno routine 240 shown schematically in FIG. 4, though the routine may be applicable to lottery games other than keno. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 9, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520 and/or printed on a ticket voucher 60 using the ticker reader/printer 56. The selection of a ticket may allow the player to choose how many game numbers to wager on, such that one ticket will only allow five numbers to be played and others will allow more or less numbers to be played. The amount of selectable numbers may depend on the wager at block 554. Alternatively, the ticket may allow the player to select any number of game numbers up to a predetermined amount. The payout tables may be adjusted accordingly resulting in, for example, a greater potential payout for more game numbers being played and a smaller potential payout for fewer game numbers being played. At block 558, the player may also be allowed to select multiple tickets, where each ticket is a wager on a different set of numbers.

At block 562, the player may select one or more game numbers, which may be within a range set by the casino. This selection may be performed manually with the player selecting each individual number, or the player may cause the gaming unit 20 to automatically select numbers on behalf of the player. If the gaming unit 20 may select the player-selected game numbers randomly or based on information about the player (e.g., the player's favorite numbers). In some lottery games, the player may make selection using a pencil or pen on the printed ticket voucher which may then be entered using the ticket reader/printer 56. Additionally, an attendant may enter the numbers on behalf of the player.

After being selected, the player's game numbers may be stored in the memory of the controller 100 at block 564 and may be included in the image 322 on the display 320 at block 566. After a certain amount of time, the keno game may be closed to additional players (where a number of players are playing a single keno game using multiple gaming units 20 or placing separate wagers over the same gaming unit).

At block 567, either the controller 100 or a central computer operatively connected to the controller, such as one of the network computers 22, 32, may replace one or more of the game numbers selected by the player at block 562 with the randomly occurring symbol 412. Likewise, block 567 may involve inserting a multiplier symbol 414. The randomly occurring symbol 412 and the multiplier symbol 414 may be inserted using a random number generator such that the game number(s) are chosen and replaced at random. The occurrence of the randomly occurring symbol 412 (i.e., whether any number will be replaced at all) and the occurrence of the multiplier symbol 414 may also be determined by the random number generator. The random number generator may comprise a pseudo-random number generation routine stored within the memory of the controller 100 (or a central computer). Alternatively, while the occurrence of the randomly occurring symbol 412 and the multiplier symbol 414 may be random, the player may be presented with an opportunity to chose which number(s) to replace or to replace no numbers at all. In yet another example, a symbol 412 may be inserted using a pseudo-random technique or a predictive technique, such that a symbol 412 replaces a number in every prime numbered game (i.e., the first, second, third, fifth, seventh, etc.), in every hundredth game, etc. Such a pseudo-random or predictive technique may be based not just on the number of games, but also on the number of wagers by a particular person, the number of wagers on a particular unit, the number of people to use the particular gaming unit, the time of day, week or year, etc. In such a case, the symbol 412 is not a truly randomly occurring symbol 412, but would otherwise possess the same characteristics as the randomly occurring symbol 412 (e.g., the symbol is representative of any of the controller-selected numbers). Pseudo-random or predictive techniques may also be used for the multiplier symbol 414.

Further at block 567, the player-selected numbers as displayed at block 566 may be replaced with an image similar to that of FIG. 8 showing the player-selected numbers including the randomly occurring symbol 412 in place of the replaced number and/or the multiplier symbol 414. In another example, the game numbers as originally chosen by the player may continue to be displayed as at block 566, and the gaming unit 20 may print a ticket voucher 60 having an image as shown in FIG. 8. The player may not realize a randomly occurring symbol 412 has replaced a player-selected number and/or a multiplier symbol 414 has been inserted until the player has selected all the game numbers and printed a ticket voucher 60. It is further contemplated that instead of a ticket voucher 60, alternative cashless payout devices may be used, as described above, to print or otherwise encode a printable or encodable material in order to print or encode the randomly occurring symbol 412 and/or the multiplier symbol 414.

If play of the keno game is to begin as determined at block 568, at block 570 a game number within a range set by the casino may be randomly selected either by the controller 100 or a central computer such as one of the network computers 22, 32. The random number selection at block 570 may be also be performed by the random number generator or pseudo-random number generator referred to above or by a separate random or pseudo-random number generator stored within the memory of the controller 100 or a separate controller 100. The game numbers may also be randomly selected using a mechanical instrument such as a rotating drum containing a number of objects, such as balls, each being associated with one of the game numbers from the range of game numbers. The rotation of the drum may randomly shuffle the objects therein such that the selection of any object is random. The selected numbers may be received by the controller 100 and stored in the memory. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or the central computer noted above) may determine whether a maximum number of game numbers within the range have been randomly selected. If not, another game number may be randomly selected at block 570. Although not depicted in FIG. 9, if the maximum number of game numbers has been selected, the keno routine 240 may substitute one of the controller-selected game numbers with a randomly occurring symbol 412 as at block 567. In fact, one or more controller-selected numbers may be replaced as an alternative to replacing one or more of the player-selected numbers. As suggested above, this may result in additional players (where a number of players are playing a single keno game using multiple gaming units 20 or placing separate wagers over the same gaming unit 20) receiving the benefit of the randomly occurring symbol 412, thereby guaranteeing at least one match for each player.

Once the maximum number of game numbers has been selected and possibly one or more of the game numbers may have been replaced with a randomly occurring symbol 412, at block 577 the controller 100 (or a central computer) may determine whether any of the game numbers selected by the player match any of the controller-selected numbers. The number of matches may depend on how many numbers the player selected and the particular keno rules being used. Part of determining matches at block 577 may include determining the presence of a randomly occurring symbol 412 and/or a multiplier symbol 414. If a randomly occurring symbol 412 has replaced one or more of the player-selected numbers, it may automatically be considered a match with any game number selected by the controller 100. Whether or not the randomly occurring symbol 412 matches any of the controller-selected numbers depends on the parameters of the game and what numbers the randomly occurring symbol 412 is meant to represent, as discussed above. At block 578, the controller 100 (or a central controller 28, 38 noted above) may determine whether there are a sufficient number of matches between the game numbers selected by the player and the game numbers selected at block 570 to cause the player to win. The determination at block 578 may take into account the occurrence of a randomly-occurring symbol 412 as determined at block 577.

If there are a sufficient number of matches, a payout may be determined at block 580 to compensate the player for winning the game. The payout may be determined in any number of ways and may be dependent on a variety of factors. For example, selecting the same game numbers as the controller 100 in any order may result in one payout, whereas selecting the same game numbers in the same order as the game numbers selected by the controller 100 may result in a higher payout. Additionally, the more game numbers wagered on by the player, as determined at block 558, may result in a higher payout. For example, selecting a five-number ticket at block 558 may have a lower potential payout versus the potential payout in selecting nine numbers because of the possibly greater potential for matching all five numbers versus matching all nine numbers. Conversely, a further factor in determining the payout may be the number of matches, such that matching three out of five numbers may result in a higher potential payout versus matching three out of nine numbers because of the greater potential for matching three out of nine numbers. The payout at block 580 may further depend on the amount of the wager, as determined at block 554, and/or the number of matches, such that matching two out of five numbers may have a lower payout than matching three out of five numbers. In some instances, it may be required that all the player-selected numbers match all the controller-selected numbers in order to receive any payout at all, and in still other cases it may be further required that the matches occur in the same order for any payout to be issued.

The payout may also be based on the occurrence of the multiplier symbol 414. For example, at block 582 the keno routine 240 determines whether a multiplier symbol 414 was present in the player's game numbers. If not, the payout determined at block 580 may remain the same and the keno routine 240 continues to block 584 to update the player's cumulative value. If a multiplier symbol 414 is present as determined at block 582, the payout is changed to reflect the amount of the multiplier symbol 414. The occurrence of the randomly occurring symbol 412 may automatically trigger the detection of the multiplier symbol 414 (i.e., the occurrence of the randomly occurring symbol 412 automatically increases the payout). However, as pointed out above, the occurrence of the randomly occurring symbol 412 does not necessarily coincide with the occurrence of a multiplier symbol 414. Therefore, block 582 may determine the presence of the multiplier symbol 414 separate from determining the presence of the randomly occurring symbol at block 577. In one example, the payout determined at block 580 may be multiplied by the multiplier factor. For example, referring to the multiplier symbol 414 shown in FIG. 8, any payout determined at block 580 would be doubled by the multiplier factor of '2'. Alternatively, the multiplier factor may be taken into account at block 580 when determining the payout.

At block 586, the player's cumulative value or number of credits may be updated by subtracting the bet made by the player and adding, if the keno game was won, the payout value determined at block 580. The cumulative value or number of credits may also be displayed in the display area 340 (FIG. 6). The player may be given the option of playing another game of keno or cashing out, in which case the cumulative value may be added to the player's account, added to a credit card, encoded on a ticket or other cashless payout apparatus. In the case of a ticket voucher 60 or other encodable medium, the player may present the ticket voucher 60 or other encoded medium to an attendant who may give the player the cash or authorize the transfer of the funds to an account. Alternatively, the player may present the ticket voucher 60 or other encoded medium to a gaming unit 20 which may in turn distribute the funds to the player as cash or transfer the funds to an account.

Substitution Routine

Figure 10:
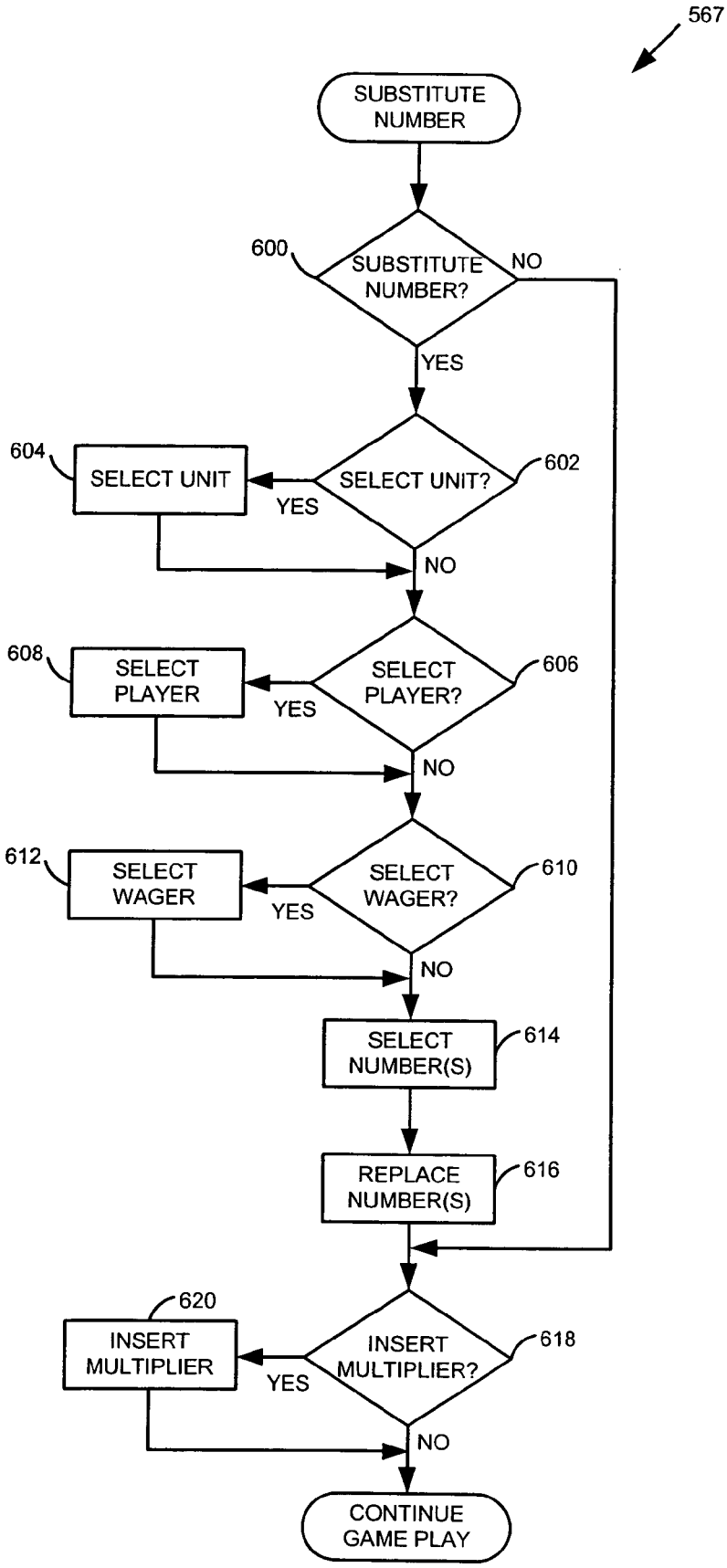
FIG. 10 is an flowchart of an embodiment of a routine that may be performed by one or more of the gaming units to replace a game number with a randomly occurring symbol.

FIG. 10 is a flowchart of the substitution routine shown schematically in FIG. 9 as block 567. As with the keno routine 240, the substitution routine 567 may be utilized in connection with a single gaming unit 20 where a single player is playing a keno game, which may be a single keno game or multiple keno games, or the substitution routine 567 may be utilized in connection with multiple gaming units 20 wherein multiple players are playing a single keno game, or the substitution routine 567 may be utilized in connection with a single gaming unit 20 where multiple players are playing a single keno game. The example of the substitution routine 567 shown in FIG. 10 is well-suited to the second case, though fewer than all aspects of the substitution routine 567 of FIG. 10 may be used for only a single gaming unit 20. Additionally, one or more of the acts described below may be performed either by a controller 100 in each gaming unit or by one of the network computers 22, 32 to which multiple gaming units 20 are operatively connected. The substitution routine 567 may further be employed at any point after a number has been selected. For example, the substitution routine 567 may be invoked after the selection of each game number as opposed to selecting all game numbers first. In another example, the substitution routine 567 may be performed for either the player-selected numbers or for the controller-selected numbers. Not all aspects of the substitution routine 567 as shown in FIG. 10 may be applicable to each possible scenario. The following description of substitution routine 567 is principally described with relation to substituting one or more of the player-selected numbers after the player has selected all the game numbers. Those of ordinary skill in the art will readily recognize those aspects of the substitution routine 567 which may or may not be applicable depending on the numbers of gaming units 20, players and games being played.

Referring to FIG. 10, at block 600, the routine may determine whether or not to initiate substitution of one of the selected game numbers. The determination at block 600 may be made randomly using a random number generator. As described further below, the substitution routine 567 includes various decisions and selections at block 602–620, any and all of which may be made using a random number generator. The random number generator for each decision or selection may comprise a software routine stored within the memory of the controller 100 (or the central computer noted above). The various decisions and selections, including the determination at block 600, may also be determined in a pseudo-random or non-random manner which may have the appearance of being random. For example, referring to block 600, a number may be substituted every $N^{th}$ day, every $N^{th}$ wager, every $N^{th}$ player, etc. (where N may or may not be an integer). Other non-random or pseudo-random methods are available as mentioned above.

If it is determined at block 600 that no game numbers will be substituted for the randomly occurring symbol 412, control may pass to block 618 to determine if a multiplier symbol 414 is to be inserted, as discussed further below. Alternatively, the determination at block 600 may include deciding whether or not to include the multiplier symbol 414 along with the randomly occurring symbol 412, rather than using a separate determination at block 618. In the latter case, if it is decided that no game numbers will be substituted for the randomly occurring symbol 412 and/or the multiplier symbol 414, the substitution routine 567 may end and game play for the keno routine 240 may continue.

On the other hand, if it is decided at block 600 that a game number is to be replaced, control may pass to various other blocks to choose the method by which a game number will ultimately be selected. The choice of substitution method may be dependent on the particular scenario as mentioned above. For example, if the substitution routine 567 is used in connection with multiple gaming units 20 (whether playing a single keno game or different keno games), control may pass to block 602 to decide whether or not a gaming unit 20 will be selected to have a game number replaced. If it is decided to select a gaming unit 20 at block 602, control may pass to block 604 to perform the selection of the gaming unit 20. Control may then proceed to block 606 to decide whether or not to select a player. If it is decided not to select a gaming unit 20 at block 602, control may pass directly to block 606. This may occur if there is only one gaming unit 20 from which to select or if it is simply decided that the substitution routine 567 will not select a game number from a specific gaming unit 20.

At block 606, the substitution routine 567 may decide whether a player will be selected. If so, control may pass to block 608 to select a player. Control may then pass to block 610. A player may be identified by a player tracking card, a player identification number 408 on a ticket voucher 60, or other means for identifying a player as mentioned above. Using the identification, the substitution routine 567 may select a player at block 610 and store the player's identification in a memory or otherwise associate the randomly occurring symbol 412 with the player's identification. If it is determined at block 606 to not select a player, control may pass to block 610. This may be the case if there is only one player from which to select, if there is no way to identify a specific player or if it is simply not desired to select a game number from a specific player.

Even if the substitution routine 567 does not decide to select a player at block 606, control may pass to block 610 to decide whether to select a wager. If the determination at block 610 is to select a wager, control may pass to block 612 to select the wager. The selected wager may be identified by the unique identification information 410 on a ticket voucher 60. Regardless of whether it is decided at block 610 to select a wager or not, control may pass from either block 610 or from block 612 to block 614 for selecting one or more game numbers. The selection of a game number at block 614 may be done by the controller 100 or a central computer. The selection at block 614 may also be done by the player, wherein the routine provides the player an opportunity to choose with game number(s) to replace with the randomly occurring symbol 412. Control may then pass to block 616 to replace the selected game number(s) with the randomly occurring symbol 412.

As seen from the example of the substitution routine 567 in FIG. 10, a game number may be selected from a specific gaming unit 20, a specific player and/or a specific wager. A game number may also be select from all available game numbers regardless of the gaming unit 20, player or wager. The substitution routine 567 may therefore be applicable or easily adapted to any scenario, whether there are single or multiple gaming units 20, players or wagers involved. Even if there are multiple gaming units 20, multiple players or multiple wagers from which to choose, the substitution routine 567 may decide not to select a game number from any of them specifically. Conversely, the substitution routine 567 may narrow down select a game number from those associated with all gaming units 20, players and/or wagers. Of course, for any of the selections at blocks 604, 606, 608 and 614 more than one gaming unit 20, player, wager or game number may be selected. It is therefore possible that a player may receive multiple randomly occurring symbols among the game numbers for a single wager. The number of game numbers to be replaced with a randomly occurring symbol 412 may be determined randomly, pseudo-randomly or non-randomly for a given gaming unit 20, player or wager. The number of game numbers to be selected and replaced may be determined prior to any selection at block 600, during the selection of game numbers at block 614 or at any point therein prior to replacing the number at block 616. Additionally, the substitution routine 567 may repeat for each randomly occurring symbol 412 to be inserted.

As mentioned above, the randomly occurring symbol 412 may include a multiplier symbol 414, which may represent a factor by which any value payout may be multiplied to increase a player's winnings. The decision to include or not include a multiplier symbol 414 may be one in the same with determining whether or not to include a randomly occurring symbol at block 600. However, the decision to include a multiplier symbol 414 may be made independently of the decision at block 600. Referring again to FIG. 10, once a game number has been replaced with the randomly occurring symbol at block 616, control may pass to block 618 decide whether or not to include a multiplier symbol 414 with the game numbers at block 618. If yes, control may pass to block 620 to insert a multiplier symbol 414. If not, control may pass back to the game play of the keno routine 240. The insertion of the multiplier symbol 414 at block 618 may include a routine similar to the rest of the substitution routine 567, wherein gaming units 20, player, wagers and game numbers may be selected for insertion of the multiplier symbol 414. Once the multiplier has been inserted at block 620, control may pass back to the game play of the keno routine 240. The decision to include a multiplier symbol 414 at block 618, the number of multiplier symbols 414 to insert and the insertion of the multiplier symbol 414 at block 620 may be random, pseudo-random, non-random, predictive, etc. as with the various other decisions and selections in the substitution routine 567.

Whether or not a game number has been substituted for a randomly occurring symbol 412 or a multiplier symbol 414 has been included, the substitution routine 567 may continue the keno routine 240, part of which may include displaying, printing or encoding any newly-substituted randomly occurring symbol 412 and/or multiplier symbol 414 on a display unit 70, a ticket voucher 60, a player tracking card, etc. Should the substitution routine 567 be used in conjunction with substituting a controller-selected number rather than a player-selected number, the selection of a gaming unit 20, a player or a wager may generally be bypassed if the controller-selected numbers are applicable to multiple gaming units 20, players or wagers. For example, multiple players making multiple wagers on multiple gaming units 20 for a single keno game will all be using the same controller-selected game numbers, so only a selection of the controller-selected game numbers is pertinent. On the other hand, if a multiple players are making multiple wagers on multiple gaming units 20 for multiple keno games, then each game of keno has a distinct set of controller-selected numbers, so the substitution routine 567 may specify a gaming unit 20, player and/or wager from which to substitute a controller-selected number.

Matching Routine

Figure 11:
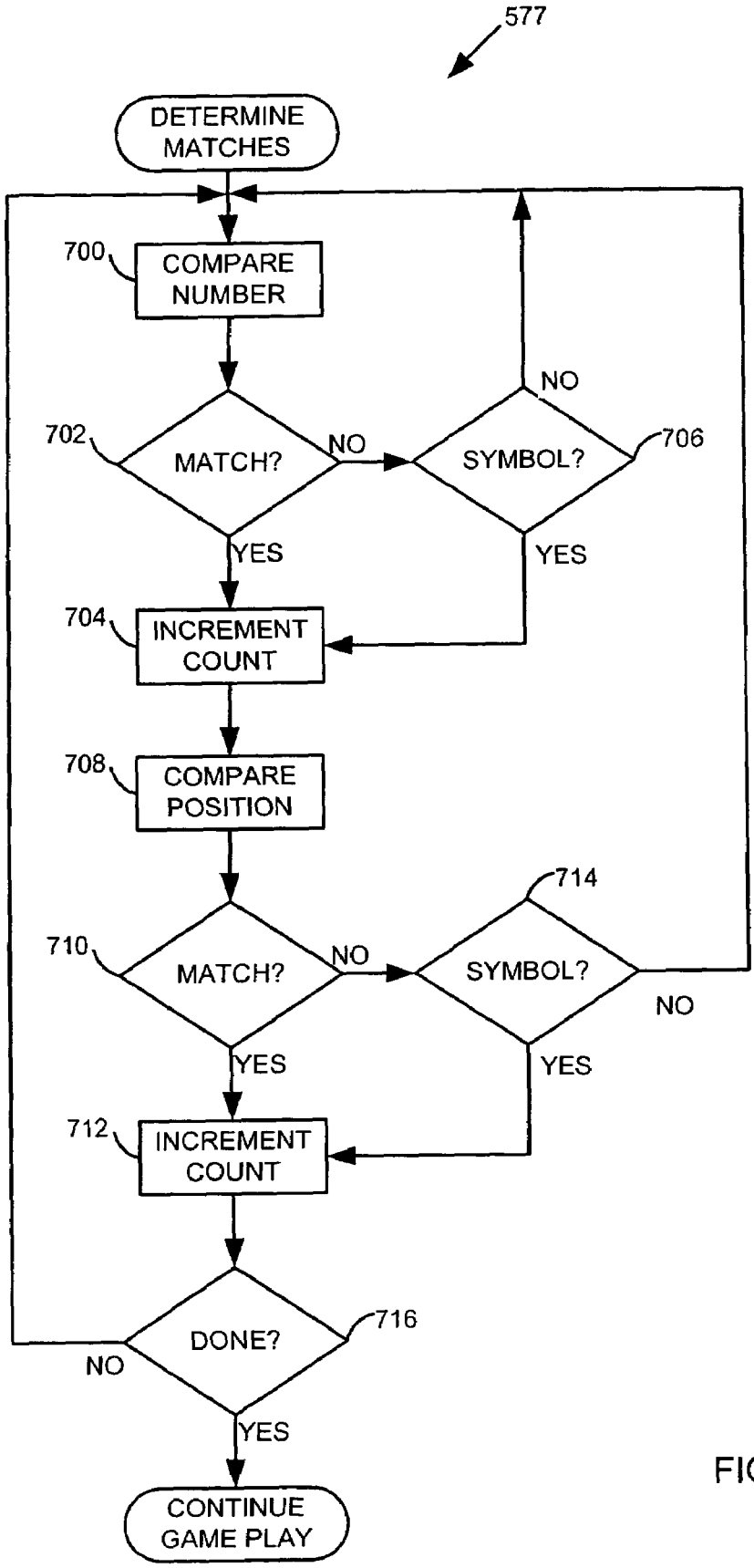
FIG. 11 is flowchart of an embodiment of a routine that may be performed to compare numbers in the keno routine of FIG. 9.

FIG. 11 is a flowchart of the matching routine shown schematically in FIG. 9 as block 577. As with the keno routine 240, the matching routine 577 may be utilized in connection with a single gaming unit 20 where a single player is playing a keno game, or the matching routine 577 may be utilized in connection with multiple gaming units 20 wherein multiple players are playing a single keno game, or the matching routine 577 may be utilized in connection with a single gaming unit 20 where multiple players are playing a single keno game.

The example of the matching routine 577 shown in FIG. 10 be performed by a controller 100 in each gaming unit or by one of the network computers 22, 32 to which multiple gaming units 20 are operatively connected. The matching routine 577 may further be employed at any point after at least one player-selected number and at least one controller-selected number have been selected. For example, the matching routine 577 may be invoked after the selection of the player-selected numbers and after the selection of each controller-selected number as opposed to selecting all controller-selected numbers. In another example, the matching routine 577 may be performed following the selection of all the player-selected numbers and all the controller-selected numbers. Not all aspects of the matching routine 577 as shown in FIG. 10 may be applicable to each possible scenario. The following description of matching routine 577 is principally described with relation to determining a match between any of the controller-selected numbers and any of the player-selected number after all the player-selected numbers and controller-selected numbers have been chosen.

Referring to FIG. 11, at block 700, the routine may compare one of the player-selected numbers with all of the controller-selected numbers. Control may then be passed to block 702 where a determination is made as to whether the player-selected number matches any of the controller-selected numbers. If there is a match, control may pass to block 704 to increment a count by one and store the result in a memory of the controller 100. If there is not a match, control may pass to block 706 to determine whether or not the player-selected number is a randomly occurring symbol 412.

If the player-selected number is a randomly occurring symbol 414 (i.e., the player-selected number was replaced by a randomly occurring symbol 414), the routine may consider it to be a match with any of the controller-selected numbers. Control may then pass to block 704 to increment the count by one, with the result stored in the memory of the controller 100. If the player-selected number is not a randomly occurring symbol 414, control may pass back to block 700 to compare the next player-selected number.

If the player-selected number matches a controller-selected number as determined at block 702 or the player-selected number is a randomly occurring symbol as determined at block 706, the count is incremented at block 704 and control passes to block 708 to determine whether the player-selected number was selected in the same order as the controller-selected number. Alternatively, control may pass to block 716 to determine if another player-selected number is to be compared, which may be the case if the order of selection is not important. At block 710, the routine may determine whether the position of the player-selected number matches the position of the controller selected number. For example, if the player-selected number is '7' and was the second number chosen by the player, and a controller-selected number is '7' and was the second number chosen by the controller 100, then the routine may consider the player-selection number and the controller-selected number to be a positional match. Control may then pass to block 712 to increment a count, which may be kept separately from the count above, and store the result in the memory of the controller 100.

If the player-selected number '7' was selected second, but the controller-selected number '7' was selected third, then the routine would determine the two to not be a match.

Control may then pass to block 714, wherein if the player-selected number is a randomly occurring symbol 412, it may be considered a positional match. Control may then pass to block 712 to increment the count. If not a randomly occurring symbol 412, control may pass back to block 700 to compare the next player-selected number.

If the position of the player-selected number matches the position of the controller-selected number as determined at block 710 or the player-selected number is a randomly occurring symbol as determined at block 714, the count is incremented at block 712 and control passes to block 716 to determine whether any other player-selected numbers are to be compared. If so, control may pass back to block 700 to compare the next player-selected number. If not, the routine may end and control may pass back to the game routine.

Government-Sponsored Lottery System

While the foregoing description has been primarily directed towards a casino gaming apparatus and a casino gaming system, those of ordinary skill in the art will readily recognize that many aspects of the foregoing description are easily adaptable to a government-sponsored lottery, such as a state-run progressive lottery. For example, elements of the casino gaming system 10, described above, may be utilized with a government-sponsored lottery network. The casino gaming system 10 may be constructed or modified to include a first group or network of lottery terminal units in place of the first network of gaming units 12. The casino gaming system 10 may further be modified to include a second group or network of lottery terminal units in place of the second network of gaming units 26. The lottery terminal units may be located in various locations across a geographic area, such as a county, state, multiple states, country, etc. The network computers 22, 32 may be modified to function as lottery network computers or servers. The lottery terminal units may be operatively coupled to the lottery network computer or server via the network data link or bus 24. The second network 26 of gaming units 30, may likewise be modified to include or be replaced with a network of lottery terminals.

Like the network computer 22, a lottery network computer may be a server computer and may be used to accumulate and analyze data relating to the operation of the lottery terminal units. The lottery network computer may receive data from each of the lottery terminal units indicative of the dollar amount and number of wagers being made on each of the lottery terminal units 20, data indicative of player selections, etc. The controller 22*a* of the network computer 22 may be replaced with or modified to function as a central lottery controller. The central lottery controller may likewise comprise a program memory, a microcontroller or microprocessor (MP), a random-access memory (RAM) and an input/output (I/O) circuit, all of which may be interconnected via an address/data bus. The I/O circuit may be coupled to the lottery network via a data link. The lottery network computer may function as a central host to which all the lottery terminal units are operatively connected. The lottery network computer may function as a central host for just the lottery terminal units on the first network or function as the central host for all lottery terminal units on all networks. In the latter case, the central host may be provided as a separate computer, or series of networked computers, separately from the lottery network computer.

As a central host, the lottery network computer and its central lottery controller may be configured to manage, execute and control the individual lottery terminals and routines. For example, the central lottery controller may be used to gather information from each lottery terminal unit such as the machine ID, sales agent, the location of each ticket voucher printed, total lottery sales, drawing outcomes, wagers, player-selected game numbers, etc. The central host may also maintain a record of the value payout(s) to be won. For example, in a progressive lottery game, each wager made at a lottery terminal (or a percentage thereof) may be added to the value payout until such time as a player wins the value payout.

Like the gaming unit 20, a lottery terminal unit may include a housing or casing and one or more input devices, which may be, among other things, a control panel, a display, a value input device such as a card reader, and a ticket reader/printer. The control panel for a lottery terminal unit may be similar to the control panel 66 shown in FIG. 2A. The input keys may allow the player or sales person to select the game to be played, input the value to be wagered, manually enter the selected lottery characters, and input any other information necessary to play a given lottery game. The value input device may further be integrated with external devices, such as cash registers or other retail terminals, communicatively connected to the lottery terminal unit 104, to exchange necessary to receive and record the wagering transactions.

Similar to the ticket reader/printer 56 of the gaming unit 20, the ticket reader/printer of the lottery terminal unit may be used to accept lottery ticket vouchers and may be configured to read, print and/or otherwise encode bar codes, magnetically stored information or any other desired input information. The ticket reader/printer may also be configured to read user selections such as player-selected game numbers that may be indicated on the lottery ticket voucher. The lottery ticket vouchers of the lottery terminal units may be similar in content and design as the ticket vouchers 60 described above, in that they may include the place of purchase, the type of ticket voucher, a validation number, a bar code with control and/or security data, the date and time of issuance of the ticket voucher, redemption instructions and restrictions, a description of an award, information concerning a player's gaming decisions, information concerning a player's wagers, and any other information that may be necessary or desirable. FIGS. 7 and 8 described above, may be used as examples of lottery ticket vouchers that may be printed by and/or read by the ticket reader/printer of the lottery terminal unit.

Just as many aspects of the casino gaming system 10 are applicable to a government-sponsored lottery system, it will be understood that many of the routines described above are equally applicable to and may be implemented with a government-sponsored lottery system. All or part of the routines may be stored and/or executed by the controller of the lottery terminal unit or by the central lottery controller. For example, the main operating routines 200, 300 described above with reference to FIGS. 4 and 5 may be modified to be executed by the central lottery controller of a central host, or by the controller of each individual lottery terminal unit. A lottery terminal unit, if provided with a display, may display an attraction sequence. Alternatively, the main operating routine of a lottery game may simply determine player participation as at blocks 204, 304 and generate a game display as at blocks 206, 306. The game displays may provide various different lottery game that the player may select and wager on at the lottery terminal unit as at block 208 of FIG. 4, or only a single lottery game to wager on. Game information of a government-sponsored lottery game may be displayed as at blocks 308, 310 of FIG. 5 and initiated as at block 312. As above, the government-sponsored lottery game may be any type of lottery game. After the government-sponsored lottery routine has been performed, the player may terminate play of the lottery as at blocks 260, 316 or place another wager. In some cases, a government-sponsored lottery may dispense a value to the player if the player terminates the game. The time between terminating play of the lottery game and dispensing a value to the player may be instantaneous (e.g., in the case of instant win lotteries) or may span several days, weeks or months if the actual selection of random numbers does not occur until a later date.

The display 320 of FIG. 6 may also be provided on the display unit of the lottery terminal unit, if provided. Alternatively, the display 320 may be provided on a publicly viewed display unit, though the display 320 may then include the video image 324 of a plurality of numbers or other indicia randomly selected by the central controller without the buttons 326, 328, 330, 332, 334, 336, 338 and areas 322, 340. In some cases, a government-sponsored lottery game may display the randomly selected numbers over a television broadcast, over the internet, through an email message, in a newspaper or other publication, in a recorded telephone message, etc.

The keno routine 240 described above may also be used as an example of a lottery game that may be executed by the controller of the lottery terminal unit and/or the central lottery controller. The central lottery controller may particularly be utilized in connection with multiple wagers being placed over multiple lottery terminals, though one or more acts may be performed by the controller of the lottery terminal unit. As mentioned above with reference to FIG. 9, it will be recognized that aspects of the keno routine 240 may also be applicable to other lottery games including various government-sponsored lotteries.

The routine for a government-sponsored lottery game may include an option to view pay tables or odds for a selected lottery game, which may be displayed on the display unit (if provided) by the lottery terminal unit controller as at blocks 550, 552. The lottery terminal unit controller may determine whether a player has placed a bet as at block 554 and update the bet data as at block 556. Updating the bet data may also be performed by the central lottery controller, wherein the central lottery controller may receive the bet data from the lottery terminal unit and store the bet data in the memory. The player may select a ticket or multiple tickets as at block 558 and the ticket(s) may be displayed as at block 560 or printed on a lottery ticket voucher by the lottery terminal unit controller. The player may select game numbers as at block 562. This selection may be performed manually by the player or automatically by either the lottery terminal unit controller or the central lottery controller. The player's numbers may be received by the central lottery controller and stored in the memory as at block 564. The player-selected numbers may also be displayed by the lottery terminal unit as at block 566 and/or printed on a lottery ticket voucher.

The central lottery controller may then cause a player-selected number to be randomly selected and replaced with a randomly occurring symbol. The randomly occurring symbol 412 and multiplier 414 as described above may likewise be used with government-sponsored lottery games. The substitution routine 567 described above with reference to FIGS. 9 and 10 is likewise applicable to government-sponsored lottery games, and may be stored and executed by the central lottery controller.

As at blocks 568, 570, 572, 574, 576 if the government-sponsored lottery game is to begin, a game number may be randomly selected. While the random selection may be performed by the central lottery controller, in some instances of a government-sponsored lottery game, the game numbers may be randomly selected by a mechanical instrument such as a rotating drum containing a number of objects, such as balls, each being associated with one of the game numbers from the range of game numbers. The rotation of the drum may randomly shuffle the objects therein such that the selection of any object is random. The selected numbers may then be received by the central lottery controller and stored in the memory. The randomly selected numbers may be displayed as at block 572, which may also include displaying the numbers via a television broadcast.

As at block 577, the central lottery controller may determine whether there are any matches between the player-selected numbers and the randomly-selected numbers. The matching routine 577 described above with reference to FIGS. 9 and 11 is likewise applicable to government-sponsored lottery games and may be stored and executed by the central lottery controller. The central lottery controller may then determine if the player is a winner as at block 578 or whether there are any winners. As at blocks 578, 580, 582, 584, the central lottery controller may further determine the payouts associated with the wager, whether a multiplier is present and changing the payout if a multiplier is present. The central lottery controller may further store a value associated with the payout attributed to the wager, rather than changing a value as at block 586. The player may receive the value payout by redeeming the lottery ticket voucher with an attendant or using the ticket reader/printer.

What is claimed is:

1. A lottery gaming system comprising:

a plurality of lottery terminals, each lottery terminal comprising:

a ticket printer capable of generating ticket vouchers, a value input device, a terminal controller operatively coupled to said ticket printer and said value input device, said terminal controller comprising a processor and a memory operatively coupled to said processor; and a lottery controller operatively coupled to each of the plurality of lottery terminals, the lottery controller comprising a processor and a memory operatively coupled to said processor, wherein said terminal controller is programmed to allow a person to make a wager on a game, wherein said terminal controller is programmed to allow said person to select a first plurality of indicia of a first type, wherein said terminal controller is programmed to communicate wager data to said lottery controller, said wager data comprising said first plurality of indicia of a first type, said lottery controller being programmed to receive said wager data from each of said lottery terminals, said lottery controller being programmed to receive data representing a second plurality of indicia of said first type, said second plurality of indicia of said first type being randomly selected, said lottery controller being programmed to replace one or more of said indicia of a first type from said first plurality of indicia with an indicia of a second type, wherein the terminal controller is programmed to cause said ticket printer to issue a ticket voucher comprising said first plurality of indicia of a first type with one or more of said indicia of the first type replaced with an indicia of the second type, said lottery controller being programmed to determine whether any of said first plurality of indicia of a first type match any of said second plurality of indicia of a first type, said lottery controller being programmed to match said indicia of a second type with at least one of said second plurality of indicia of a first type, and said lottery controller being programmed to determine a value payout associated with an outcome of said game.

2. A lottery gaming system as defined in claim 1, wherein said lottery controller is further programmed to randomly associate a multiplier factor with said wager, and wherein said lottery controller is programmed to multiply said value payout by said by said multiplier factor.

3. A lottery gaming system as defined in claim 2, wherein said lottery controller is programmed to randomly assign a value to said multiplier factor, and wherein said lottery controller is programmed to multiply said value payout by said randomly assigned value.

4. A lottery gaming system as defined in claim 2, wherein said lottery controller is programmed to randomly associate said multiplier factor with said indicia of a second type.

5. A lottery terminal, comprising:

a ticket printer capable of generating ticket vouchers, a value input device, a terminal controller operatively coupled to said ticket printer and said value input device, said terminal controller comprising a processor and a memory operatively coupled to said processor;

said terminal controller being programmed to allow a person to make a wager on a game;

said terminal controller further being programmed to allow said person to select a first plurality of indicia of a first type;

said terminal controller further being programmed to communicate wager data to a lottery controller, said wager data comprising said first plurality of indicia of a first type, and to receive data form the lottery controller representing a second plurality of indicia of said first type, said second plurality of indicia of said first type being randomly selected and replacing one or more of said indicia of a first type from said first plurality of indicia with an indicia of a second type; and wherein the terminal controller is programmed to cause said ticket printer to issue a ticket voucher comprising said first plurality of indicia of a first type with one or more of said indicia of the first type replaced with an indicia of the second type.

6. The lottery terminal of claim 5, wherein said lottery terminal further receives a multiplier value from the lottery controller.

7. A lottery controller operatively coupled to each of a plurality of lottery terminals, the lottery controller comprising:

a processor and a memory operatively coupled to the processor;

wherein the lottery controller selectively receiving game data from the plurality of lottery terminal including a wager on a game, wherein in each game a person to selects a first plurality of indicia of a first type, the lottery controller randomly selecting a second plurality of indicia of said first type and replacing one or more of said indicia of a first type from said first plurality of indicia in the game data with an indicia of a second type;

the lottery controller being programmed to determine whether any of said first plurality of indicia of a first type match any of said second plurality of indicia of a first type;

the lottery controller being programmed to match said indicia of a second type with at least one of said second plurality of indicia of a first type, and said lottery controller being programmed to determine a value payout associated with an outcome of said game.

8. The lottery controller of claim 7, wherein said lottery controller is further programmed to randomly associate a multiplier factor with said wager, and wherein said lottery controller is programmed to multiply said value payout by said by said multiplier factor.

9. The lottery controller of claim 7, wherein said lottery controller is further programmed to randomly assign a value to said multiplier factor, and wherein said lottery controller is programmed to multiply said value payout by said randomly assigned value.

10. The lottery controller of claim 7, wherein said lottery controller is further programmed to randomly associate said multiplier factor with said indicia of a second type.

* * * * *